US007410563B2

(12) United States Patent
Komatsu et al.

(10) Patent No.: US 7,410,563 B2
(45) Date of Patent: Aug. 12, 2008

(54) METHOD AND APPARATUS FOR PREVENTING CORROSION OF CONTACT

(75) Inventors: Kazuhiro Komatsu, Hyogo (JP); Masahiko Fujimoto, Hyogo (JP); Kouji Oonishi, Hyogo (JP); Keisuke Kido, Hyogo (JP); Junichi Sawada, Hyogo (JP)

(73) Assignee: Fujitsu Ten Limited, Kobe (JP)

( * ) Notice: Subject to any disclaimer, the term of this patent is extended or adjusted under 35 U.S.C. 154(b) by 379 days.

(21) Appl. No.: 11/068,393

(22) Filed: Mar. 1, 2005

(65) Prior Publication Data

US 2005/0231858 A1 Oct. 20, 2005

(30) Foreign Application Priority Data

Apr. 5, 2004 (JP) ..... P2004-111031

(51) Int. Cl.
*C23F 13/06* (2006.01)

(52) U.S. Cl. ..... 205/725; 205/726; 205/727; 204/196.02; 204/196.05; 204/196.06; 204/196.11; 204/196.26

(58) Field of Classification Search ..... 205/725, 205/726; 204/196.02, 196.05, 196.06, 196.11, 204/196.26
See application file for complete search history.

(56) References Cited

U.S. PATENT DOCUMENTS

| | | | | |
|---|---|---|---|---|
| 4,134,026 | A * | 1/1979 | Sone et al. | 307/137 |
| 5,502,609 | A | 3/1996 | Thomas et al. | |
| 5,523,633 | A | 6/1996 | Imaizumi et al. | |
| 2005/0231876 | A1 | 10/2005 | Komatsu et al. | |
| 2005/0231877 | A1 | 10/2005 | Komatsu et al. | |

FOREIGN PATENT DOCUMENTS

| | | |
|---|---|---|
| EP | 0 528 379 A2 | 2/1993 |
| JP | A 63-237319 | 10/1988 |
| JP | A 1-281621 | 11/1989 |
| JP | A 2-278620 | 11/1990 |
| JP | A 2-297818 | 12/1990 |
| JP | A 3-205710 | 9/1991 |
| JP | A 4-33220 | 2/1992 |
| JP | A 6-96637 | 4/1994 |
| JP | A 7-6650 | 1/1995 |
| JP | A 7-14463 | 1/1995 |
| JP | A 7-15301 | 1/1995 |
| JP | A 2001-84860 | 3/2001 |
| JP | A 2002-343171 | 11/2002 |

* cited by examiner

*Primary Examiner*—Bruce F Bell
(74) *Attorney, Agent, or Firm*—Oliff & Berridge, PLC

(57) ABSTRACT

A method for preventing corrosion of a contact, includes comparing a potential of a signal line connected to the contact with a predetermined potential corresponding to the corrosion of the contact; flowing a corrosion-prevention current into the contact when a result of the comparing shows that the contact is corroded; inputting into the signal line a signal used for judging a logical value of a connection state of the contact; and in the magnitude relation, setting the predetermined potential on another side of a threshold level used in the judging of the logical value of the connection state of the contact.

24 Claims, 16 Drawing Sheets

FIG. 17

| SETTING OF INPUT CIRCUIT | FUNCTION FOR PREVENTING CORROSION OF CONTACT | SEL 1 | SEL 2 | SEL 3 |
|---|---|---|---|---|
| L SIDE SW | ○ | H | L | H |
| L SIDE SW | × | H | L | L |
| H SIDE SW | ○ | L | H | H |
| H SIDE SW | × | L | H | L |
| WITHOUT PULL-UP / PULL-DOWN CONNECTION | × | L | L | L |

METHOD AND APPARATUS FOR PREVENTING CORROSION OF CONTACT

BACKGROUND OF THE INVENTION

1. Field of the Invention

The present invention relates to a method and an apparatus for preventing corrosion of a contact, which can break an oxide coating produced on a contact of a switch, a connector, etc. by applying a large current, thereby preventing the contact from being corroded.

2. Description of the Related Art

As well known in the art, a contact of a switch, a connector, etc. is formed of a metallic material having high conductivity, so that small contact resistance is induced upon electrical connection. In the contact, under a non-connection state which corresponds to an off state, since a surface of the contacting portion is oxidized, contact resistance is likely to increase. Also, under a connection state, which corresponds to anon state, since a surface of a portion exposed around the contacting portion is oxidized, a produced oxide is likely to roll up toward the contacting portion to provoke fine sliding wear, which increases contact resistance. Although contact resistance of a contact increases due to oxidization, if a contacting state and a non-contacting state are appropriately repeated and a substantially large current is applied under the contacting state, the oxide can be removed through heating by current flow, whereby it is possible to prevent contact resistance from increasing.

In association with an input to an electronic apparatus, it is not necessary to always apply a large current capable of preventing corrosion to a contact. When the large current flows intermittently, malfunction may result from noise generation. Also, if the large current flows through the contact, a lifetime of the contact may be markedly shortened, or the contact is likely to melt. In order to cope with these problems, an apparatus for controlling a current of a contact has been disclosed in JP-A-Hei.2-297818, in which contact resistance of a contact is detected and, when the contact resistance is not less than a predetermined reference value, a large current is applied through contacts.

Also, a circuit for preventing corrosion of a switch has been disclosed in U.S. Pat. No. 5,523,633, in which when using a switch for a large current in a system having a low current level, such as an electronic unit, a large current is applied in the form of a pulse while a contact of the switch is turned on. Further, a contact signal discrimination device has been disclosed in JP-A-Hei.7-14463, in which a pulse-shaped corrosion-prevention current is periodically applied using charge and discharge to and from a condenser. Moreover, JP-A-2002-343171 has disclosed an apparatus for preventing corrosion of a contact of a switch, wherein a large current for preventing corrosion is applied for at least a predetermined holding time starting from a point of time the contact of the switch transits from an opened state to a closed state, and when the contact of the switch is in the opened state, impedance of an input signal line connected to the contact is decreased.

SUMMARY OF THE INVENTION

In the JP-A-Hei.2-297818, U.S. Pat. No. 5,523,633, Jp-A-Hei.7-14463, and JP-A-2002-343171 does not consider to attempt that a subsequent stage, which operates depending upon an opened/closed state of the contact does not malfunction while a corrosion-prevention current is applied to prevent corrosion of a contact. For instance, if a large current for preventing corrosion flows with contacts being closed, a generated voltage at a contact having increased contact resistance increases due to voltage drop. As a result, there is a fear that the subsequent stage may misjudge that the contact is in the opened state. Also, if the corrosion-prevention current flows in the form of a pulse, noise may be generated in a surrounding area.

Accordingly, the present invention has been made to solve the above-mentioned problems. The invention provides a method and an apparatus for preventing corrosion of a contact, which can prevent corrosion of a contact and malfunction in use of an opened/closed state of the contact.

According to one embodiment of the invention, a method for preventing corrosion of a contact, includes comparing a potential of a signal line connected to the contact with a predetermined potential corresponding to the corrosion of the contact, wherein (a) when the potential of the signal line is on one side with respect to the predetermined potential in a magnitude relation, a result of the comparing shows that the contact is corroded; and (b) when the potential of the signal line is on the other side with respect to the predetermined potential in the magnitude relation, the result of the comparing shows that the contact is not corroded; flowing a corrosion-prevention current into the contact when the result of the comparing shows that the contact is corroded; inputting into the signal line a signal used for judging a logical value of a connection state of the contact; and in the magnitude relation, setting the predetermined potential on the other side with respect to a threshold level used in the judging of the logical value of the connection state of the contact.

With this method, the potential of the signal line connected to the contact is compared with the predetermined potential corresponding to the corrosion of the contact. When the potential of the signal line is on one side with respect to the predetermined potential in a magnitude relation, a result of the comparing shows that the contact is corroded. At this time, the corrosion-prevention current is flown into the contact to remove the oxide from the contact and reduce the contact resistance, so that the contact is restored. That is, this method can prevent the corrosion of the contact. In the magnitude relation, the predetermined potential is set on the other side with respect to the threshold level used in the judging of the logical value of the connection state of the contact. For example, if the contact is associated with a low-side switch, the predetermined potential is set on the ground potential side with respect to the threshold level. On the contrary, if the contact is associated with a high-side switch, the predetermined potential is set on the source potential with respect to the threshold level. In a state where the corrosion of the contact does not proceed and the low-side switch is closed, the potential of the signal line is between the ground potential and the predetermined potential. On the other hand, in a state where the corrosion of the contact does not proceed and the high-side switch is closed, the potential of the signal line is between the source potential and the predetermined potential. If the corrosion of the contact has proceeded and the low-side switch is closed, the potential of the signal line exceeds the predetermined potential and is on the ground potential side with respect to the threshold level in the magnitude relation. Also, if the corrosion of the contact has proceeded and the high-side switch is closed, the potential of the signal line lowers below the predetermined potential and is on the source potential side with respect to the threshold level in the magnitude relation. Even if the corrosion-prevention current flows into the contact, it is expected that the contact resistance decreases before the potential of the signal line does not reach the threshold level for logical judgment. Therefore, when using an opened/closed state of the contact, malfunction can be prevented.

According to one embodiment of the invention, an apparatus for preventing corrosion of a contact includes a signal line, a power source, a switch, an impedance element, and a comparator. The signal line is connected to the contact wherein a potential of the signal line is used for judging a connection state of the contact; a switch, an impedance element, and a comparator. The switch is connected between the signal line and the power source. When the switch is turned on, the switch allows current to flow into the signal line through the switch. The impedance element is connected in parallel to the switch, between the signal line and the power source. An impedance of the impedance element is larger than that of the switch. The comparator compares the potential of the signal line with a predetermined potential corresponding to the corrosion of the contact. When the potential of the signal line is on one side with respect to the predetermined potential in a magnitude relation, the comparator judges that the contact is corroded and turns on the switch. When the potential of the signal line is on the other side with respect to the predetermined potential in the magnitude relation, the comparator shows that the contact is not corroded. A signal, which is used for judging a logical value of a connection state of the contact, is input into the signal line. The predetermined potential is set on the other side with respect to a threshold level used in the judging of the logical value of the connection state of the contact, in the magnitude relation.

With this configuration, when the potential of the signal line is on one side with respect to the predetermined potential in a magnitude relation, the comparator judges that the contact is corroded and turns on the switch. At this time, the current flows into the contact and the signal line through the switch. Therefore, the apparatus can prevent the corrosion of the contact. Also, it is expected that the contact resistance decreases before the potential of the signal line does not reach the threshold level for logical judgment. Therefore, when using an opened/closed state of the contact, malfunction can be prevented.

According to one embodiment of the invention, a method for preventing corrosion of a contact includes comparing a potential of a signal line connected to the contact with a predetermined potential corresponding to the corrosion of the contact; flowing a corrosion-prevention current into the contact when a result of the comparing shows that the contact is corroded; and while the corrosion-prevention current is flown, suppressing influence of potential variation, which occurs in the signal line, on a subsequent circuit.

With this method, the potential of the signal line connected to the contact is compared with the predetermined potential corresponding to the corrosion of the contact. When the potential of the signal line is on one side with respect to the predetermined potential in a magnitude relation, a result of the comparing shows that the contact is corroded. At this time, the corrosion-prevention current is flown into the contact to remove the oxide from the contact and reduce the contact resistance, so that the contact is restored. That is, this method can prevent the corrosion of the contact. While the corrosion-prevention current is flown, influence of potential variation, which occurs in the signal line, on a subsequent circuit is suppressed. Therefore, even if the potential of the signal line varies due to flowing of the corrosion-prevention current, malfunction at a time of using the opened/closed state of the contact can be prevented.

According to one embodiment of the invention, a method for preventing corrosion of a contact, includes comparing a potential of a signal line connected to the contact with a predetermined potential corresponding to the corrosion of the contact; flowing a corrosion-prevention current into the contact when a result of the comparing shows that the contact is corroded; and reducing frequency of the flowing of the corrosion-prevention current.

With this method, the potential of the signal line connected to the contact is compared with the predetermined potential corresponding to the corrosion of the contact. When the potential of the signal line is on one side with respect to the predetermined potential in a magnitude relation, a result of the comparing shows that the contact is corroded. At this time, the corrosion-prevention current is flown into the contact to remove the oxide from the contact and reduce the contact resistance, so that the contact is restored. That is, this method can prevent the corrosion of the contact. Since the frequency of the flowing of the corrosion-prevention current is reduced, frequency of malfunction of the subsequent stage, which is associated with an operation of flowing the corrosion-prevention current. Therefore, the malfunction at a time of using the opened/closed state of the contact can be prevented.

According to one embodiment of the invention, a method for preventing corrosion of a contact includes comparing a potential of a signal line connected to the contact with a predetermined potential corresponding to the corrosion of the contact; flowing a corrosion-prevention current into the contact when a result of the comparing shows that the contact is corroded; and reducing an impedance of the signal line with respect to a noise.

With this method, the potential of the signal line connected to the contact is compared with the predetermined potential corresponding to the corrosion of the contact. When the potential of the signal line is on one side with respect to the predetermined potential in a magnitude relation, a result of the comparing shows that the contact is corroded. At this time, the corrosion-prevention current is flown into the contact to remove the oxide from the contact and reduce the contact resistance, so that the contact is restored. That is, this method can prevent the corrosion of the contact. Since the impedance of the signal line with respect to the noise is reduced, the noise resistance characteristic is improved. Also, the potential variation on the signal line due to the noise is suppressed. Therefore, the malfunction at a time of using the opened/closed state of the contact can be prevented.

BRIEF DESCRIPTION OF THE DRAWINGS

FIG. 17 is a table illustrating functions of the corrosion prevention apparatus 102Cx of FIG. 16.

DETAILED DESCRIPTION OF THE PREFERRED EMBODIMENT

Figure 1A:
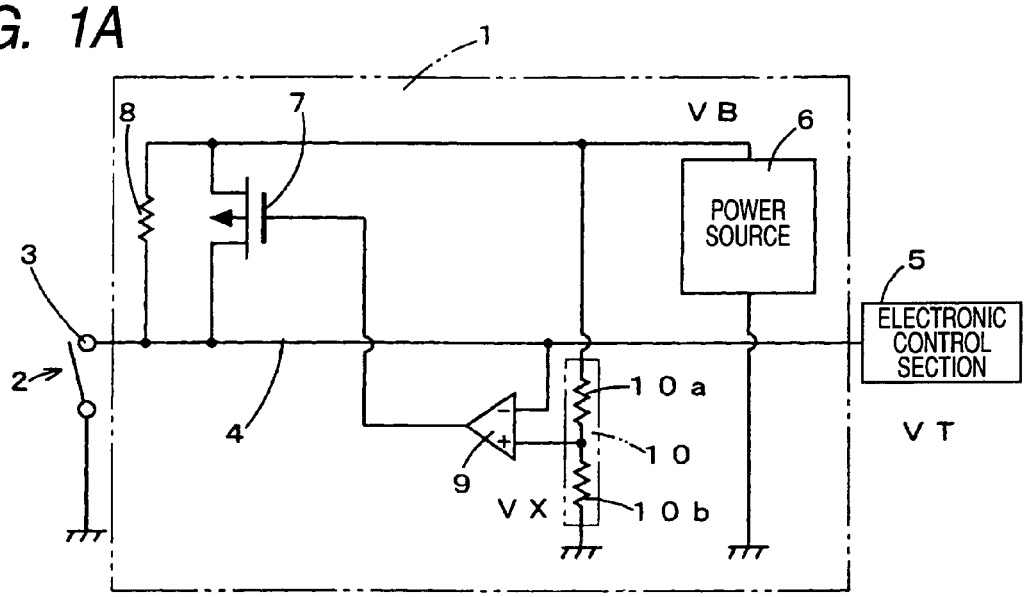
FIG. 1 is a block diagram illustrating a schematic electrical configuration of an apparatus 1 for preventing corrosion of a contact in accordance with a first embodiment of the present invention and timing charts illustrating examples of operation.

Hereinafter, preferred embodiments of the present invention will be described with reference to the attached drawings. In respective embodiments, the parts having the same functions as those previously mentioned will be designated by the same reference numerals, and detailed description thereof will be omitted. However, it should be noted that, although the same reference numerals are used, those parts must not be construed to necessarily have exactly the same configuration, and therefore, various changes can be made without departing from the scope and spirit of the present invention. Further, features of the respective embodiments may be combined with those of the other embodiments desirably.

FIG. 1 illustrates a schematic electrical configuration of an apparatus 1 for preventing corrosion of a contact in accordance with a first embodiment of the present invention and examples of operation. FIG. 1A illustrates the electrical configuration. The apparatus 1 for preventing corrosion of a contact has a function of preventing a contact 3 of a switch 2 from being corroded. The contact 3 is connected to an input side of a rearward electronic control section 5 via an input signal line 4. The contact 3 maybe a connector. The apparatus 1 for preventing corrosion of a contact is embodied as a part of a large-scale integrated circuit (LSI). A power source 6 generates, from power supplied externally of the LSI, a source voltage for operation of a logical circuit and then, supplies the generated source voltage to the interior of the LSI. The source voltage for operation of the logical circuit is, for example, 5V or 3.3V. The power source 6 is grounded at a low side and outputs the source voltage from a high side. Depending upon a type or a configuration of the switch 2 or a connector, the number and a structure of contacts 3 may be different. Anyway, contact resistance of the contact 3 represents electrical resistance between surface portions, which are brought into contact with each other to be electrically connected.

The switch 2 is connected to the low side of the power source 6. If the switch 2 is turned on, the contact 3 is connected to a ground potential. A switching element 7 serving as a switch and a resistor 8 serving as an impedance element are connected to the signal input line 4 and the high side of the power source 6. The switching element 7 is embodied as, for example, a P channel MOS transistor. A comparator 9 compares a potential of the input signal line 4 with a predetermined potential VX, which is given by a reference potential source 10. When the potential of the input signal line 4 is on one side with respect to the predetermined potential VX in a magnitude relation, the comparator 9 outputs a driving signal to the switching element 7. On the other hand, when the potential of the input signal line 4 is on the other side with respect to the predetermined potential VX in the magnitude relation, the comparator 9 does not output the driving signal. Specifically, when the comparator 9 judges that the potential of the input signal line 4 is greater than the predetermined potential VX (that is, the potential of the input signal line 4 is on the one side with respect to the predetermined signal in the magnitude relation), the comparator 9 outputs and applies the driving signal to the gate of the switching element 7. The predetermined potential is set so that if the input signal line 4 takes the predetermined potential, the contact 3 is corroded. The comparator 9 has an inverting input terminal, which is connected to the input signal line 4, and a non-inverting input terminal, which is connected to the predetermined potential VX applied by the reference potential source 10. The reference potential source 10 includes, for example, a divider circuit having resistors 10*a* and 10*b*, and is formed to divide a source potential VB. In the case that the potential of the input signal line 4 is less than the predetermined potential VX toward the ground potential, the logical output of a high level Hi is obtained from the comparator 9 as a driving signal, and the switching element 7 being the P channel MOS transistor is turned off. In the case that the potential of the input signal line 4 is greater than the predetermined potential VX toward the high side of the power source 6, the logical output of a low level Lo is obtained from the comparator 9, and the switching element 7 being the P channel MOS transistor is turned on. If the switch 2 is turned off, the potential of the input signal line 4 becomes greater than the predetermined potential VX, and the switching element 7 is turned on. In the on state of the switching element 7, the impedance of the input signal line 4 becomes less than that under the off operation of the switching element 7. However, when the switch 2 is in the off state, a current does not flow to the contact 3, whereby power consumption does not increase.

During the on operation of the switching element 7, the switching element 7 connects the input signal line 4 and the high side of the power source 6, with an impedance, which is lower than the resistance value of the resistor 8. At this time, if the switch 2 is turned on, a corrosion-prevention current capable of removing an oxide flows into the contact 3. With the switching element 7 turned off, since the impedance of the switching element 7 is greater than the resistance value of the resistor 8 and an impedance between the input signal line 4 and the high side of the power source 6 increases. At this time, if the switch 2 is turned on, an amount of the current flowing through the contact 3 is small and an oxide removing function vanishes. However, power consumption decreases.

Figure 1B:
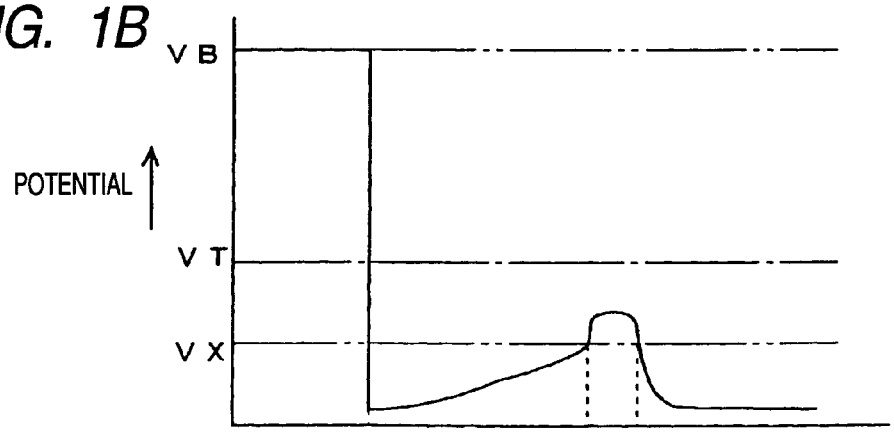
Figure 1C:
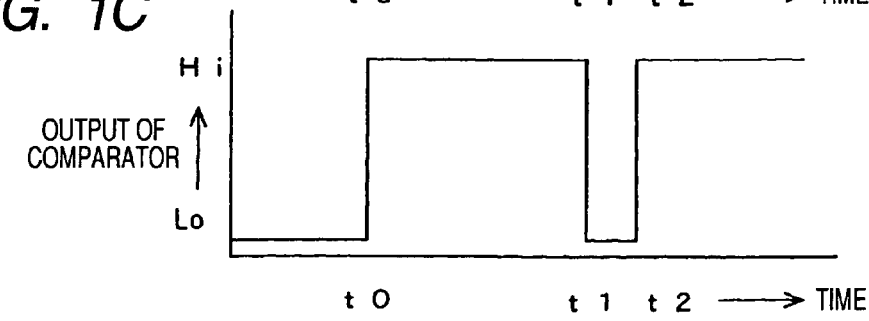

FIG. 1B illustrates a potential variation of the input signal line 4, and FIG. 1C illustrates a logical output change of the comparator 9. As shown in FIG. 1B, in a case where the switch 2 is connected to the low side, the predetermined potential VX given by the reference potential source 10 to the comparator 9 is set to be closer to the ground potential than the threshold level VT based on which the rearward electronic control section 5 implements logical judgment. In other words, the predetermined potential VX is on the other side with respect to the threshold level VT in the magnitude relation. For example, in a state in which the switch 2 is maintained in the off state up to time t0, the potential of the input signal line 4 connected to the contact 3 nearly approaches to the source potential VB, the logical output of the comparator 9 becomes a low level as shown in FIG. 1C, and the switching element 7 is driven in the on state. If the switch 2 is turned on at time t0 as shown in FIG. 1B, the potential of the input signal line 4 decreases close to the ground potential. Since this potential is lower than the predetermined potential VX, the logical output of the comparator 9 becomes a high level as shown in FIG. 1C, and the switching element 7 is driven in the off state. Accordingly, the impedance of the input signal line 4 is changed to a high impedance state due to the resistance value of the resistor 8, and a current flowing through the contact 3 of the switch 2 decreases.

It is supposed that contact resistance increases due to fine sliding wear of the contact 3, and as shown in FIG. 1B, the potential of the input signal line 4 exceeds the predetermined potential VX at time t1. In this situation, since the logical output of the comparator 9 transits to the low level as shown in FIG. 1C, the switching element 7 is driven in the on state, and a substantially large corrosion-prevention current flows into the contact 3 through the switching element 7 to remove the oxide, whereby contact resistance decreases up to time t2 to restore the contact 3. Since a substantially large current flows through the contact 3 between times t1 and t2 as shown in FIG. 1B, the potential of the input signal line 4 further increases. However, because the predetermined potential VX is set to be on the other side with respect to the threshold level VT in the magnitude relation (that is, the predetermined potential VX is on the non-judgment side of the threshold level VT), it is possible to cause a potential variation not to approach to the threshold level VT, whereby misjudgment at the rearward electronic control section 5 can be prevented.

Figure 2A:
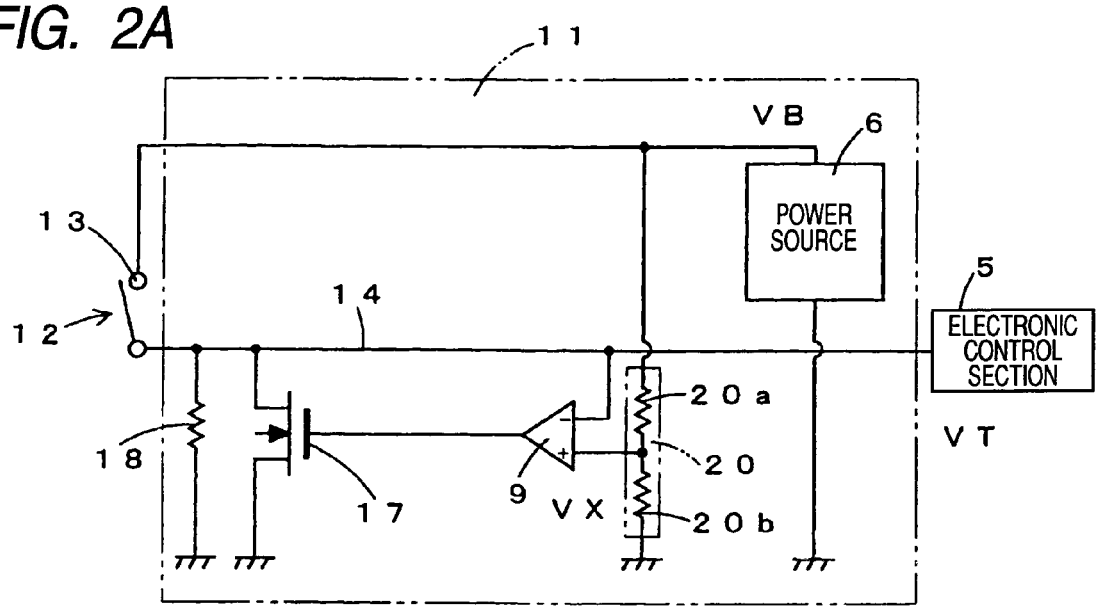
FIG. 2 is a block diagram illustrating a schematic electrical configuration of an apparatus 11 for preventing corrosion of a contact in accordance with a second embodiment of the present invention and timing charts illustrating examples of operation.

FIG. 2 illustrates a schematic electrical configuration of an apparatus 11 for preventing corrosion of a contact in accordance with a second embodiment of the present invention and examples of operation. FIG. 2A illustrates the electrical configuration. The apparatus 11 for preventing corrosion of a contact has a function of preventing a contact 13 of a switch 12 from being corroded. The contact 13 is connected to an input side of a rearward electronic control section 5 via an input signal line 14. The contact 13 may be a connector. The apparatus 11 for preventing corrosion of a contact is embodied as a part of an LSI. A power source 6 generates, from power supplied externally of the LSI, a source voltage for operation of a logical circuit and then, supplies the generated source voltage to the interior of the LSI. The source voltage for operation of the logical circuit is, for example, 5V or 3.3V. The power source 6 is grounded at a low side and outputs the source voltage from a high side. Depending upon a type or a configuration of the switch 12 or a connector, the number and a structure of contacts 13 may be different. Anyway, contact resistance of the contact 13 represents electrical resistance between surface portions, which are brought into contact with each other to be electrically connected.

The switch 12 is connected to the high side of the power source 6. If the switch 12 is turned on, the contact 13 is connected to a source potential VB. On the input signal line 14, a switching element 17 serving as a switch and a resistor 18 serving as an impedance element are connected to the low side of the power source 6. The switching element 17 is embodied as, for example, an N channel MOS transistor. A comparator 9 compares a potential of the input signal line 14 with a predetermined potential VX, which is given by a reference potential source 20. When the potential of the input signal line 14 is on one side with respect to the predetermined potential VX in a magnitude relation, the comparator 9 outputs a driving signal to the switching element 17. On the other hand, when the potential of the input signal line 14 is on the other side with respect to the predetermined potential VX in the magnitude relation, the comparator 9 does not output the driving signal. Specifically, when the comparator 9 judges that the potential of the input signal line 14 is less than the predetermined potential VX (that is, the potential of the input signal line 4 is on the one side with respect to the predetermined signal in the magnitude relation), the comparator 9 outputs and applies a driving signal to the gate of the switching element 17. The comparator 9 has an inverting input terminal, which is connected to the input signal line 14, and a non-inverting input terminal, which is connected to the predetermined potential VX given by the reference potential source 20. The reference potential source 20 includes , for example, a divider circuit having resistors 20*a* and 20*b*, and is formed to divide the source potential VB. In the case that the potential of the input signal line 14 is greater than the predetermined potential VX toward the source potential VB, the logical output of a low level is obtained from the comparator 9 as a driving signal, and the switching element 17 being the N channel MOS transistor is turned off. In the case that the potential of the input signal line 14 is less than the predetermined potential VX toward the low side of the power source 6, the logical output of a high level is obtained from the comparator 9, and the switching element 17 being the N channel MOS transistor is turned on. If the switch 12 is turned off, the potential of the input signal line 14 becomes less than the predetermined potential VX, and the switching element 17 is turned on. In the on state of the switching element 17, the impedance of the input signal line 14 becomes less than that under the off operation of the switching element 17. However, when the switch 12 is in the off state, a current does not flow into the contact 13, where by power consumption does not increase.

During the on operation of the switching element 17, the switching element 17 connects the input signal line 14 and the ground corresponding to the low side of the power source 6 are connected, at an impedance which is lower than the resistance value of the resistor 18. At this time, if the switch 12 is turned on, a corrosion-prevention current capable of removing an oxide flows into the contact 13. With the switching element 17 turned off, since the impedance of the switching element 17 is greater than the resistance value of the resistor 18 and an impedance between the input signal line 14 and the low side of the power source 6 increases. At this time, if the switch 12 is turned on, an amount of the current flowing through the contact 13 is small and an oxide removing function vanishes. However, power consumption decreases.

Figure 2B:
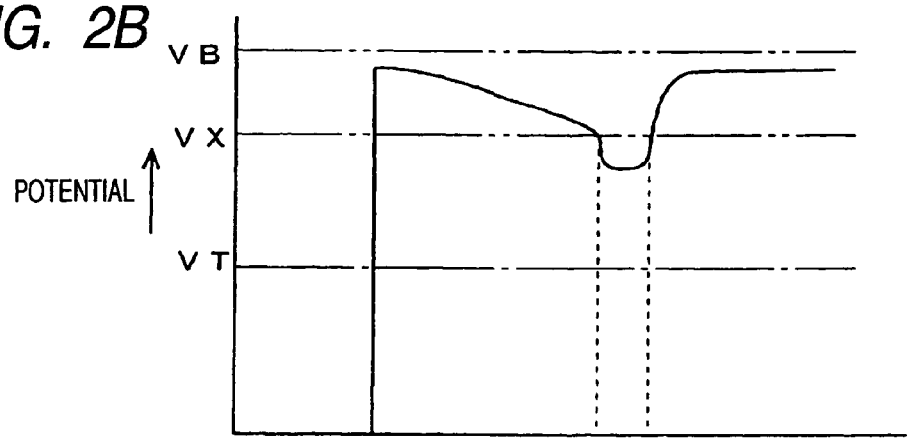
Figure 2C:
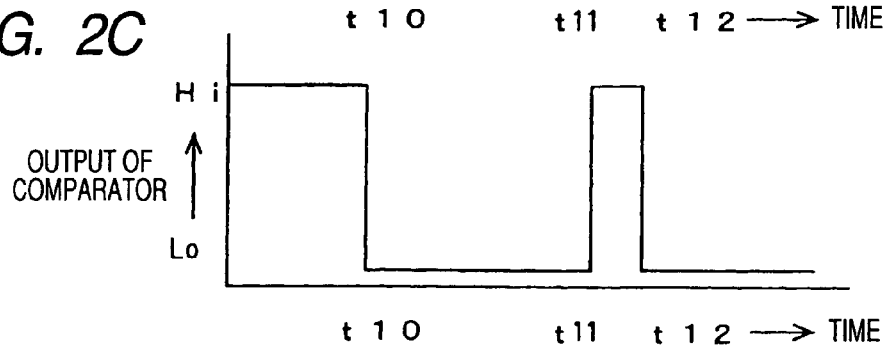

FIG. 2B illustrates a potential variation of the input signal line 14, and FIG. 2C illustrates a logical output change of the comparator 9. As shown in FIG. 2B, in a case where the switch 12 is connected to the high side, the predetermined potential VX given by the reference potential source 20 to the comparator 9 is set to be closer to the source potential VB than the threshold level VT based on which the rearward electronic control section 5 implements logical judgment. In other words, the predetermined potential VX is on the other side with respect to the threshold level VT in the magnitude relation. For example, in a state in which the switch 12 is maintained in the off state up to time t10, the potential of the input signal line 14 connected to the contact 13 nearly approaches to the ground potential, the logical output of the comparator 9 becomes a high level as shown in FIG. 2C, and the switching element 17 is driven in the on state. If the switch 12 is turned on at time t10 as shown in FIG. 2B, the potential of the input signal line 14 increases close to the source potential VB. Since this potential is higher than the predetermined potential VX, the logical output of the comparator 9 becomes a low level as shown in FIG. 2C, and the switching element 17 is driven in the off state. Accordingly, the impedance of the input signal line 14 is changed to a high impedance state due to the resistance value of the resistor 18, and a current flowing through the contact 13 of the switch 12 decreases.

It is supposed that contact resistance increases due to fine sliding wear of the contact 13, and as shown in FIG. 2B, the potential of the input signal line 14 becomes lower than that of the predetermined potential VX at time t11. In this situation, since the logical output of the comparator 9 transits to the high level as shown in FIG. 2C, the switching element 17 is driven in the on state, and a substantially large corrosion-prevention current flows into the contact 13 through the switching element 17 to remove the oxide, whereby contact resistance decreases up to time t12 to restore the contact 13. Since a substantially large current flows through the contact 13 between times t11 and t12 as shown in FIG. 2B, the potential of the input signal line 14 further decreases. However, because the predetermined potential VX is set to be on the other side with respect to the threshold level VT (in other words, the predetermined potential VX is on the other side of the threshold level VT in the magnitude relation), it is possible to cause a potential variation not to approach to the threshold level VT, whereby misjudgment at the rearward electronic control section 5 and the like can be prevented.

Figure 3:
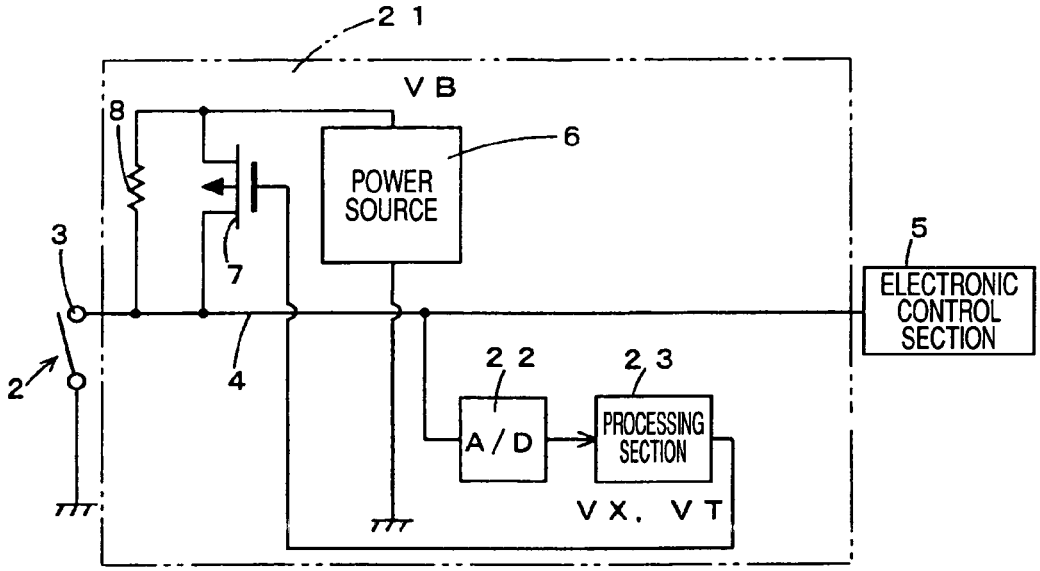
FIG. 3 is a block diagram illustrating a schematic electrical configuration of an apparatus 21 for preventing corrosion of a contact in accordance with a third embodiment of the present invention.

FIG. 3 illustrates a schematic electrical configuration of an apparatus 21 for preventing corrosion of a contact in accordance with a third embodiment of the present invention. The apparatus 21 for preventing corrosion of a contact includes analog/digital (A/D) conversion section 22 for performing analog/digital conversion with respect to a signal input into the input signal line 4, and processing section 23 for comparing a conversion result of the analog/digital conversion section 22 with the predetermined potential VX to serve as a comparator and a processing unit for comparing the conversion result of the analog/digital conversion section 22 with the threshold level VT to thereby implementing logical judgment. In the case that the input signal line 4 is set as an input to the analog/digital conversion section 22, it is not necessary to separately provide a comparator and a logical judgment section, and by effectively using the conversion value of the analog/digital conversion section 22, it is possible to miniaturize a circuit scale.

While the switch 2 is provided on the low side as with FIG. 1, in the case of using the switch 12 provided on the high side as shown in FIG. 2, in place of the high side switching element 7 and the resistor 8 of FIG. 1, the switching element 17 and the resistor 18 are connected to the low side. In the other embodiments given below, although one of the low side and the high side is explained, it should be noted that the other of the low side and the high side can be constructed in the same manner as described above.

The processing section 23 may function as a level changing section capable of changing the predetermined potential VX and the threshold level VT. Since the predetermined potential VX and the threshold level VT can be changed, it is possible to optimally select the predetermined potential VX depending upon a kind of the contact 3. Also, depending upon a frequency of operation for flowing the corrosion-prevention current or depending upon an operating situation, it is possible to dynamically change the predetermined potential VX. For example, at an activation time, in order to increase a frequency of flowing the corrosion-prevention current through the contact 3, the predetermined potential VX is changed toward a judgment implementation side, for example, toward the ground potential side in the case of the contact 3 of the low side switch 2 or toward the source potential side in the case of the contact 13 of the high side switch 12.

It is preferred that a comparator such as the comparator 9 of FIGS. 1 and 2 or the processing section 23 of FIG. 3 has hysteresis in the predetermined potential VX. Also, it is preferred that a hysteresis comparator be used as the comparator 9. In the processing section 23, it is possible to implement the function of a comparator by means of program processing. If the hysteresis is not provided in the predetermined potential VX, which is used for corrosion judgment for applying the corrosion-prevention current, due to a chattering phenomenon in which mechanical opening/closing of the contact 3 of the switch 2 is intermittently repeated, one situation in which the corrosion-prevention current flows by judgment of corrosion and the other situation in which the corrosion-prevention current does not flow by judgment of non-corrosion are repeated, whereby the potential of the input signal line 4 is likely to largely fluctuate to thereby give adversely influence on processing operation. If hysteresis is provided with the predetermined potential VX, even though the corrosion-prevention current flows upon judgment of corrosion and then prevent the contact 3 from being corroded to thereby generate the chattering phenomenon, the corrosion-prevention current is prevented from repeatedly flowing, whereby rearward adverse influence may be avoided. Further, even though the judgment of corrosion is made based on the conversion value from the analog/digital conversion section 22, the comparator 9 shown in FIGS. 1 and 2 may of course be used instead. In the following respective embodiments, the judgment of corrosion can be implemented through comparison by the comparator or through processing the analog/digital conversion value of the potential.

Figure 4:
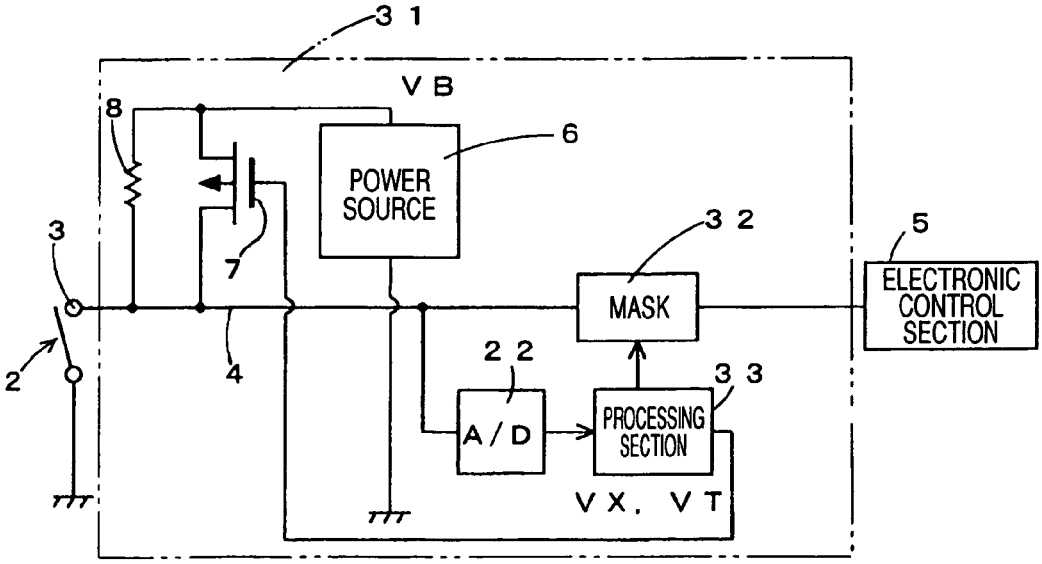
FIG. 4 is a block diagram illustrating a schematic electrical configuration of an apparatus 31 for preventing corrosion of a contact in accordance with a fourth embodiment of the present invention.

FIG. 4 illustrates a schematic electrical configuration of an apparatus 31 for preventing corrosion of a contact in accordance with a fourth embodiment of the present invention. In the apparatus 31 for preventing corrosion of a contact, a mask section 32 serving as a process inhibiting section is inserted in the input signal line 4. If processing section 33 judges that the conversion value of the potential from the analog/digital conversion section 22 exceeds the predetermined potential VX, the switching element 7 is driven in an on state to be brought in a low impedance state. Also, while the contact 3 is closed and the corrosion-prevention current flows, the mask section 32 blocks adverse influence on the rearward electronic control section 5. In a method for preventing corrosion of a contact, by comparing the potential of the input signal line 4 connected to the contact 3 with the predetermined potential VX corresponding to the corrosion of the contact 3 and flowing the corrosion-prevention current into the contact 3, when it is decided that the contact 3 is corroded, during a period in which the corrosion-prevention current flows into the contact 3, it is possible to suppress adverse influence of a potential variation occurring in the input signal line 4 on the rear part by using the mask section 32. By comparing the potential of the input signal line 4 connected to the contact 3 with, for example, the predetermined potential VX, which is set in advance in consideration of an increase in contact resistance by the corrosion of the contact 3, when it is judged that the contact 3 is corroded, the corrosion-prevention current flows through the contact 3 to remove the oxide from the contact 3, so that contact resistance decreases and the contact 3 is recovered. In this way, it is possible to prevent the corrosion of the contact 3. Also, during the period in which the corrosion-prevention current flows, the adverse influence on the rear part due to the potential variation occurring in the input signal line 4 is suppressed. Therefore, even though the potential of the input signal line 4 changes by the application of the corrosion-prevention current, it is possible to cause the potential variation not to adversely influence the rear part. As a consequence, it is possible to prevent the malfunction when the rear electronic control section 5 uses the opened and closed states of the contact 3. Further, in place of the mask section 32, a filter may be employed as the process inhibiting section.

Figure 5:
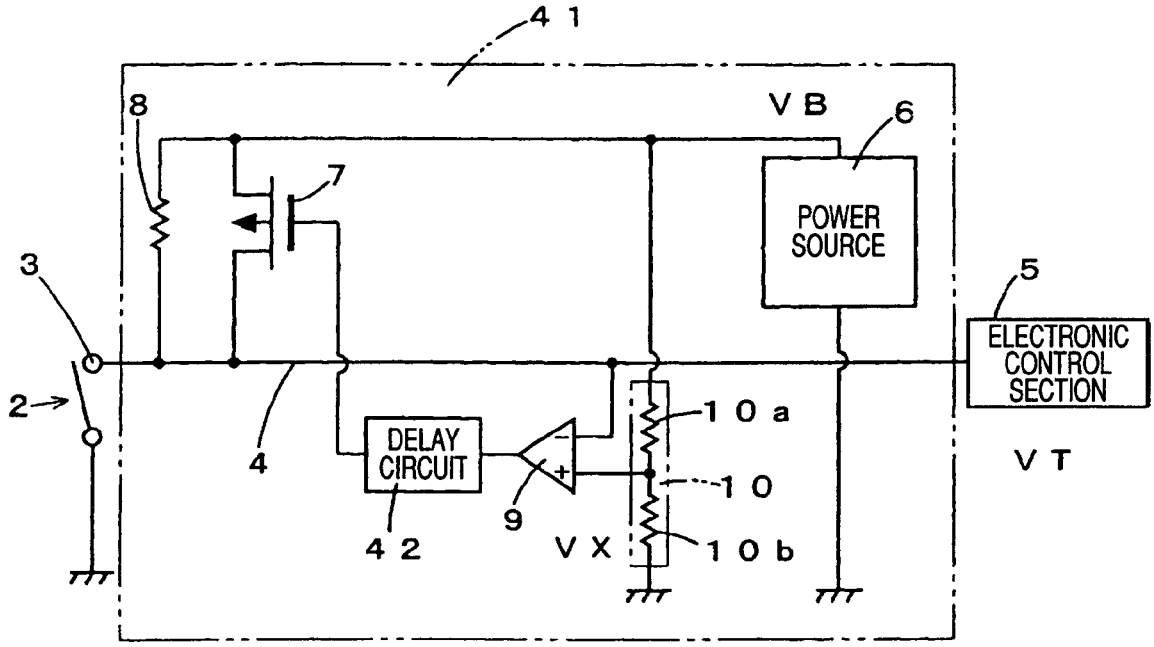
FIG. 5 is a block diagram illustrating a schematic electrical configuration of an apparatus 41 for preventing corrosion of a contact in accordance with a fifth embodiment of the present invention.

FIG. 5 illustrates a schematic electrical configuration of an apparatus 41 for preventing corrosion of a contact in accordance with a fifth embodiment of the present invention. In the apparatus 41 for preventing corrosion of a contact, a delay circuit 42 is provided between the logical output of the comparator 9 and a control signal electrode (the gate) of the switching element 7. When the comparator 9 serving as the comparator turns on the switching element 7 serving as the switch to decrease the impedance of the input signal line 4 and to flow the corrosion-prevention current, the delay circuit 42 serves as a current holding section that holds for a predetermined minimum time period a state where the corrosion-prevention current is kept flowing.

Figure 6A:
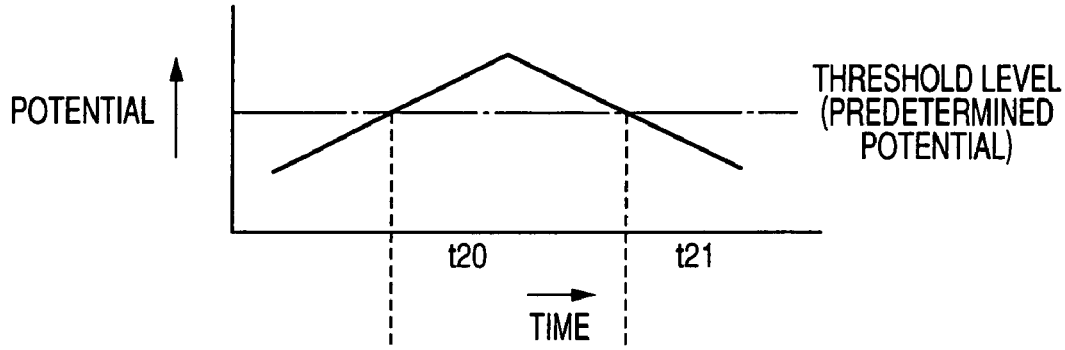
FIG. 6 is timing charts respectively illustrating an exemplary potential variation of an input signal line 4 in FIG. 5, a result of logical judgment by a corresponding comparator 9, and a variation in a logical output of a delay circuit 42.
Figure 6B:
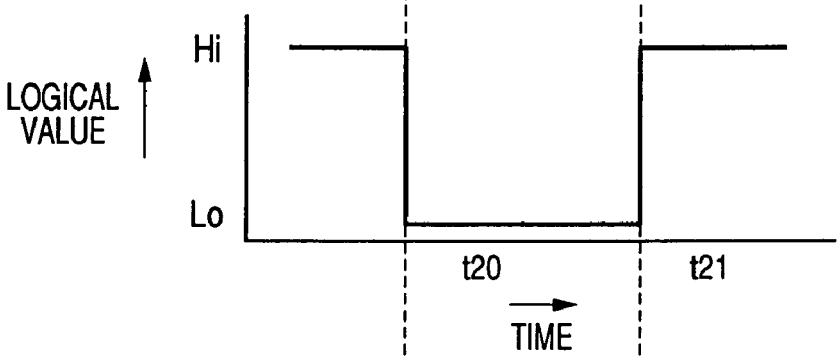
Figure 6C:
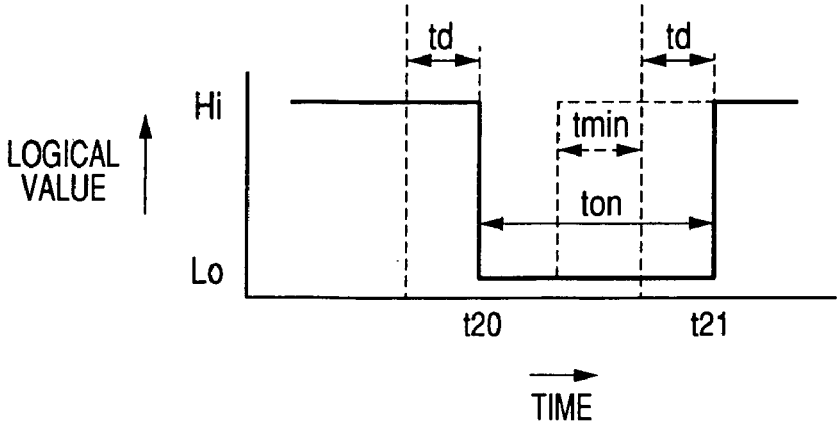

FIG. 6 illustrates operation of the delay circuit 42 shown in FIG. 5. FIG. 6A illustrates a change of the potential of the input signal line 4, which is input to the comparator 9, FIG. 6B illustrates a logical output of the comparator 9, and FIG. 6C illustrates an output of the delay circuit 42. If an input to the comparator 9 exceeds the predetermined potential VX from time t20 to time t21 as shown in FIG. 6A, the logical output of the comparator 9 becomes a low level as shown in FIG. 6B. In the case that the delay circuit 42 has a delay time period of td which is, for example, about 5 μs and the same logic is continuously maintained for the delay time period td, the delay circuit 42 outputs the logical value after the delay time period td. Accordingly, as shown in FIG. 6C, after the delay time period td is lapsed from time t20, the output of the delay circuit 42 becomes the low level. As shown by the dotted line, the output of the delay circuit 42 keeps low level for a minimum time period tmin, which is equal to the delay time period td. If the time period from time t20 to time t21 is greater than the delay time period td, after the delay time period td is lapsed from time t21, the output of the delay circuit 42 is changed to a high level.

The delay circuit 42 serves as a current holding section. Therefore, at the time the corrosion-prevention current flows in a state in which the switching element 7 is controlled to allow the input signal line 4 to have a low impedance, the delay circuit 42 continuously holds the flowing state of the corrosion-prevention current for the predetermined minimum time period tmin. If the corrosion-prevention current flows as the comparator 9 judges that corrosion takes place, the potential of the input signal line 4 is changed, whereby the chattering of corrosion preventing operation in which the judgment of occurrence of corrosion is repeated is likely to occur. In this regard, since the delay circuit 42 continuously holds the flowing state of the corrosion-prevention current for the predetermined minimum time period tmin, it is possible to prevent the contact 3 from being corroded. The chattering of the corrosion preventing operation is avoided. As a result, it is possible to prevent the malfunction when the rear electronic control section 5 uses the opened and closed states of the contact 3.

The delay circuit 42 of FIG. 5 serves as a delay section for delaying the control over the switching element 7 which serves as a switch, when the comparator 9 serving as a comparator judges that the contact 3 is corroded, so that the control over the switching element 7 is implemented after the judgment of corrosion is continuously made for the predetermined time period. Namely, the delay circuit 42 delays the control of making the input signal line 4 to have the low impedance and flowing the contact corrosion-prevention current so that the control is performed after the judgment of the corrosion continues for the predetermined time period. Therefore, over action of the corrosion preventing operation can be prevented to thereby decrease a frequency of the corrosion preventing operation. As a consequence, malfunction when using the opened and closed states of the contact is prevented.

Figure 7:
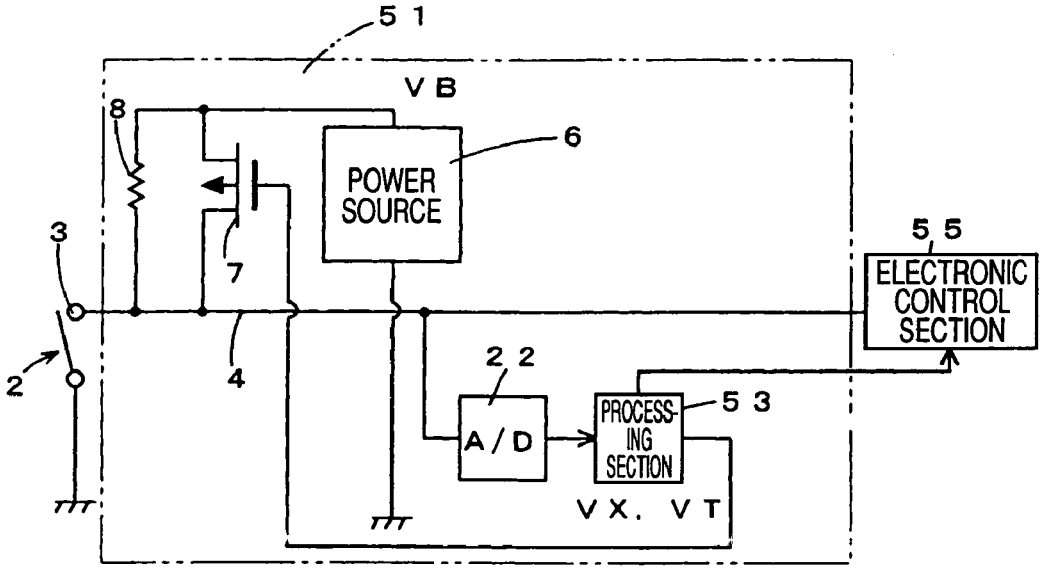
FIG. 7 is a block diagram illustrating a schematic electrical configuration of an apparatus 51 for preventing corrosion of a contact in accordance with a sixth embodiment of the present invention.

FIG. 7 illustrates a schematic electrical configuration of an apparatus 51 for preventing corrosion of a contact in accordance with a sixth embodiment of the present invention. The apparatus 51 for preventing corrosion of a contact includes a processing section 53. The processing section 53 serves as a comparator for controlling the switching element 7 and also serves as a process inhibiting section for controlling a processing circuit such as a electronic control section 55, which is connected to a rear end of the input signal line 4. The processing section 53 serving as the process inhibiting section fixes an output of the rear processing circuit during a period in which the corrosion-prevention current flows. Since the output of the rear processing circuit is fixed while the corrosion-prevention current flows, it is possible to prevent the temporary potential variation of the input signal line 4 due to the corrosion-prevention current from adversely influencing the rear processing circuit.

It is preferred that the processing section 53 serving as the process inhibiting section fixes the output of the rear processing circuit not only for the time period during which the corrosion-prevention current flows but also for a predetermined time period after that time period during which the corrosion-prevention current flows. Therefore, after application of the corrosion-prevention current is completed, if the output of the processing circuit is fixed until the potential of the input signal line 4 is stabilized, an input logic is not used in the processing of the rear part to thereby prevent malfunction.

Figure 8:
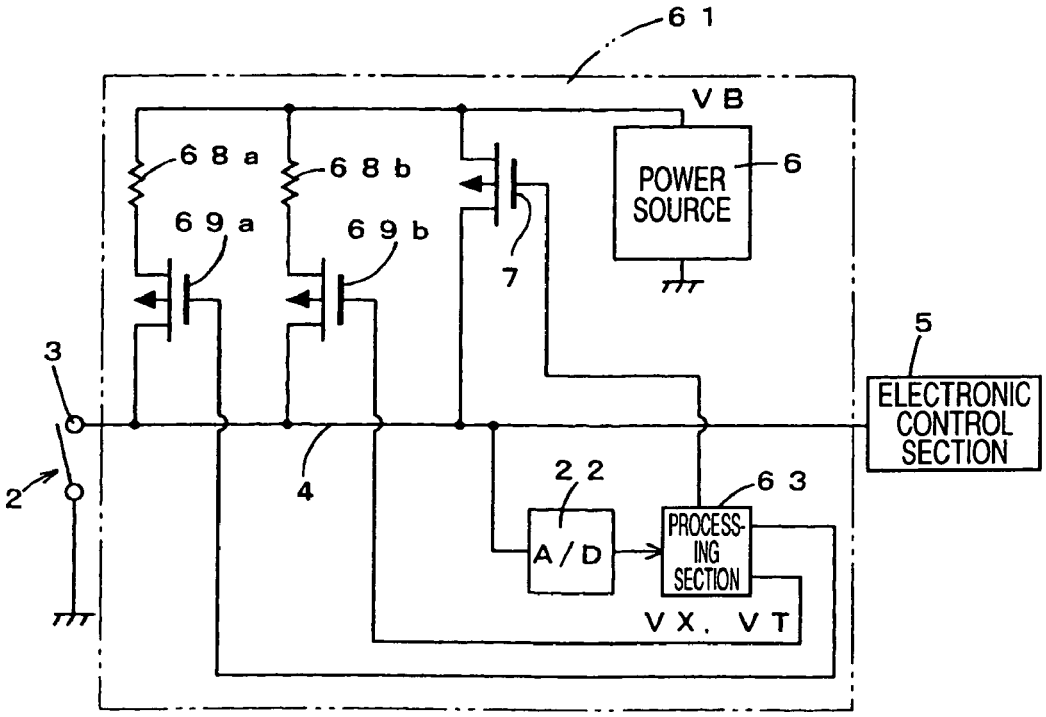
FIG. 8 is a block diagram illustrating a schematic electrical configuration of an apparatus 61 for preventing corrosion of a contact in accordance with a seventh embodiment of the present invention.

FIG. 8 illustrates a schematic electrical configuration of an apparatus 61 for preventing corrosion of a contact in accordance with a seventh embodiment of the present invention. The apparatus 61 for preventing corrosion of a contact includes processing section 63, and a plurality of resistors 68*a* and 68*b* as an impedance element. Although the two resistors 68*a* and 68*b* are illustrated for the sake of simplicity in explanation, it should be noted that three or more resistors may be employed as a matter of course. The processing section 63 can select at least one of the plurality of resistors 68*a* and 68*b* to selectively drive switching devices 69*a* and 69*b*. The processing section 63 compares the potential of the input signal line 4, which is connected to the contact 3 and is treated as a digital value converted by analog/digital conversion section 22, with the predetermined potential VX at which the corrosion of the contact 3 may take place to judge whether or not the contact 3 is corroded. When the processing section 63 judges that the corrosion takes place, the switching element 7 serving as a switch is driven in an on state to allow the input signal line 4 to have the low impedance.

The apparatus 61 for preventing corrosion of a contact includes a switch, the impedance element and the comparator. The impedance element comprises a plurality of impedances, which maintain the input signal line 4 at a high impedance state. The apparatus 61 can select at leas tone of the plurality of impedances. That is to say, the impedance element may have the plurality of impedances such as a pull-up impedance in the case of the contact 3 for the illustrated low side switch 2 and a pull-down impedance in the case of the contact 3 for an un-illustrated high side switch, so that at least one impedance can be selected from the plurality of impedances. By selecting the plurality of impedances depending upon a state of the contact, an impedance variation can be reduced during operation of the contact corrosion prevention circuit, while the corrosion of the contact is prevented. Also, a potential variation can be suppressed while the corrosion-prevention current flows. As a result, malfunction when using the opened and closed states of the contact can be prevented.

Figure 9:
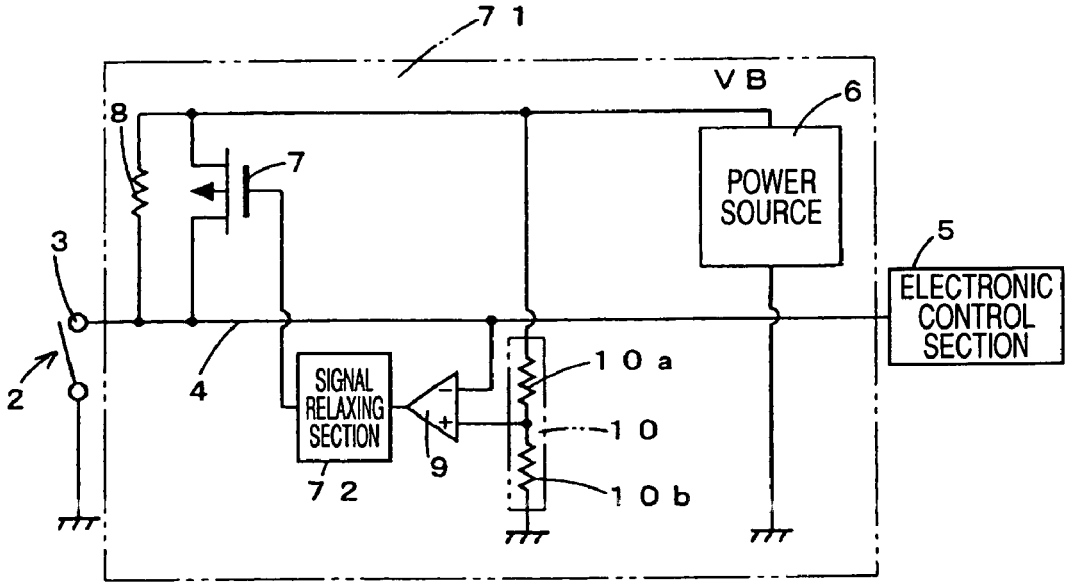
FIG. 9 is a block diagram illustrating a schematic electrical configuration of an apparatus 71 for preventing corrosion of a contact in accordance with an eighth embodiment of the present invention.

FIG. 9 illustrates a schematic electrical configuration of an apparatus 71 for preventing corrosion of a contact in accordance with an eighth embodiment of the present invention. The apparatus 71 for preventing corrosion of a contact includes a signal relaxing section 72. The signal relaxing section 72 functions to relax a variation of the driving signal for driving the switching element 7 serving as a switch, output from the comparator 9 serving as a comparator. The switching element 7 is driven by the driving signal, which is output when the comparator 9 serving as the comparator judges that the contact 3 is corroded. Therefore, if the switching element 7 is turned on to make the impedance of the input signal line 4 to have a low value and the contact 3 is closed, the corrosion-prevention current flows into the contact 3. As a result, the contact 3 can be prevented from being corroded. Since the signal relaxing section 72 relaxes the variation of the driving signal, which drives the switching element 7 and is output from the comparator 9, an impedance variation at the switching element 7, which follows the driving of the switching element 7, can be reduced so that a variation of the corrosion-prevention current also is reduced. Also, variation of the contact potential when breaking the oxide is suppressed so that malfunction when using the opened and closed states of the contact can be prevented.

If the switching element 7 has a MOS transistor, an input capacitance between the gate and the channel is relatively high. In the case where the corrosion-prevention current does not flow even when the switching element 7 is turned on with the contact 3 being in the opened state, a driving signal input through the input capacitance enters the input signal line 4 to generate noise. In this regard, because a variation of the driving signal is relaxed by the signal relaxing section 72, it is possible to suppress generation of noise.

Figure 10:
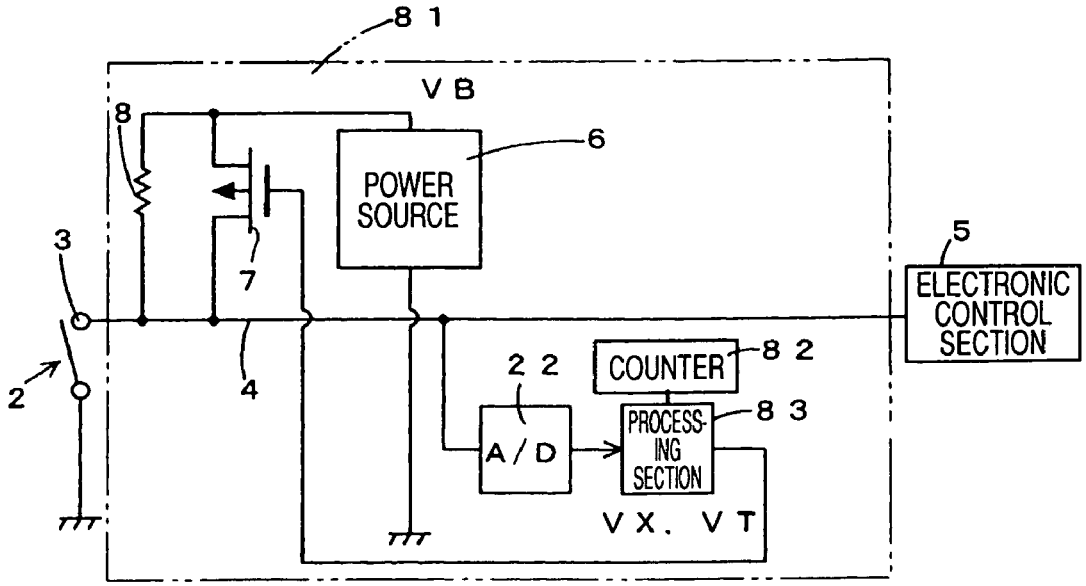
FIG. 10 is a block diagram illustrating a schematic electrical configuration of an apparatus 81 for preventing corrosion of a contact in accordance with a ninth embodiment of the present invention.

FIG. 10 illustrates a schematic electrical configuration of an apparatus 81 for preventing corrosion of a contact in accordance with a ninth embodiment of the present invention. In the apparatus 81 for preventing corrosion of a contact, processing section 83, which has a counter 82, serves as comparator. The counter 82 counts number of times the potential of the input signal line 4 exceeds the predetermined potential VX. If the counted number of the counter 82 reaches a predetermined number, the processing section 83 controls the switching element 7 serving as a switch to allow the corrosion-prevention current to flow. In other words, when the counted number of the counter 82 reaches a predetermined number, the processing section 83 serving as the comparator controls the switching element 7 to be in the on state so that the corrosion-prevention current can flow. As a consequence, over action of the corrosion preventing operation is prevented to decrease a frequency of the corrosion preventing operation, whereby malfunction when using the opened and closed states of the contact 3 can be prevented.

Further, the counter 82 may count the number for a predetermined time period. Because the processing section 83 serving as the comparator counts the number for the predetermined time, when judgment of corrosion is implemented many times during the predetermined time period, it is decided that corrosion actually takes place and the corrosion-prevention current is flown.

As described above, the potential of the input signal line 4, which is connected to the contact 3, is compared with the predetermined potential VX at which the corrosion of the contact 3 may take place. When it is judged that the corrosion of the contact 3 takes place, the frequency of operation for allowing the corrosion-prevention current to flow decreases by the method for preventing corrosion of a contact which causes the corrosion-prevention current to flow through the contact 3. Thus, a frequency of subsequent malfunction, which follows the operation for allowing the corrosion-prevention current to flow, can be decreased, whereby it is possible to prevent malfunction when using the opened and closed states of the contact 3.

Figure 11:
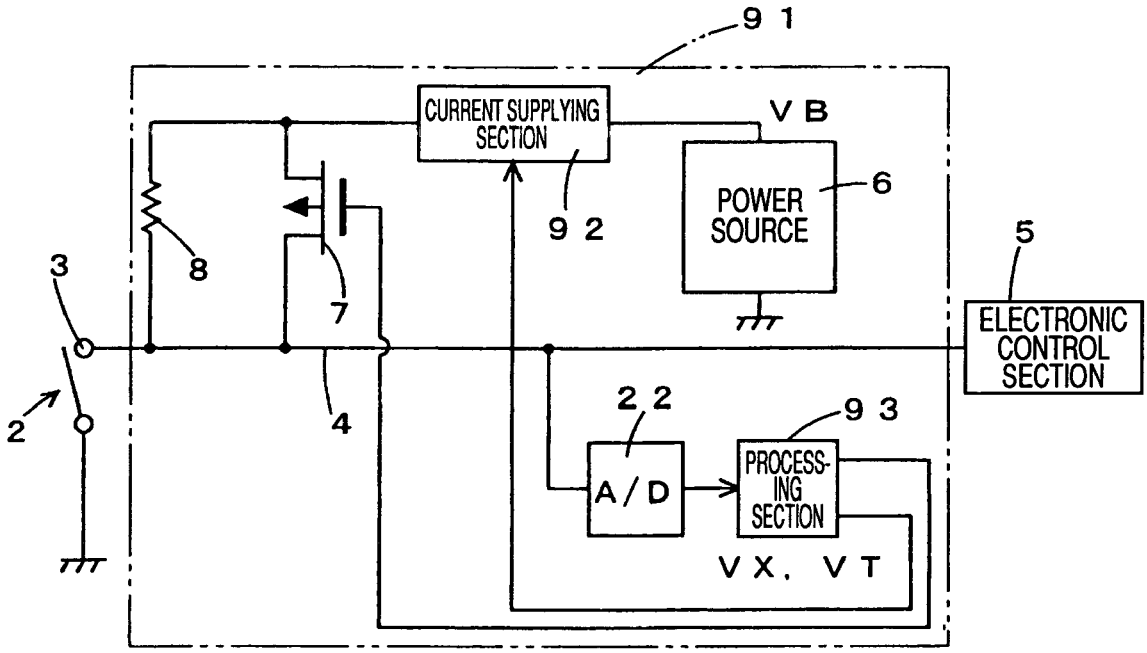
FIG. 11 is a block diagram illustrating a schematic electrical configuration of an apparatus 91 for preventing corrosion of a contact in accordance with a tenth embodiment of the present invention.

FIG. 11 illustrates a schematic electrical configuration of an apparatus 91 for preventing corrosion of a contact in accordance with a tenth embodiment of the present invention. The apparatus 91 for preventing corrosion of a contact includes a current supplying section 92 and processing section 93. The processing section 93 serves as a comparator, which compares the potential of the input signal line 4 with the predetermined potential VX at which the corrosion of the contact 3 may take place to judge whether or not the contact 3 is corroded. When it is judged that the corrosion takes place, the processing section 93 controls the switching element 7 so that the input signal line 4 has the low impedance. The current supplying section 92 can change an energization pattern to supply the corrosion-prevention current under the control of the processing section 93.

Figure 12A:
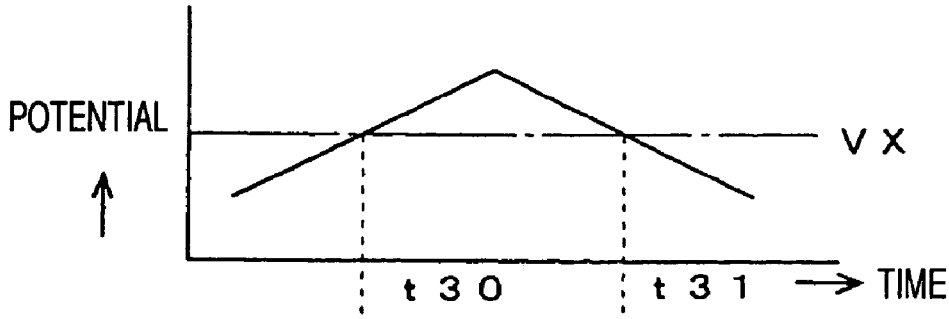
FIG. 12 is timing charts respectively illustrating an exemplary potential variation of an input signal line 4 in FIG. 11, and exemplary patterns of a current which can be supplied by current supplying section 92.
Figure 12B:
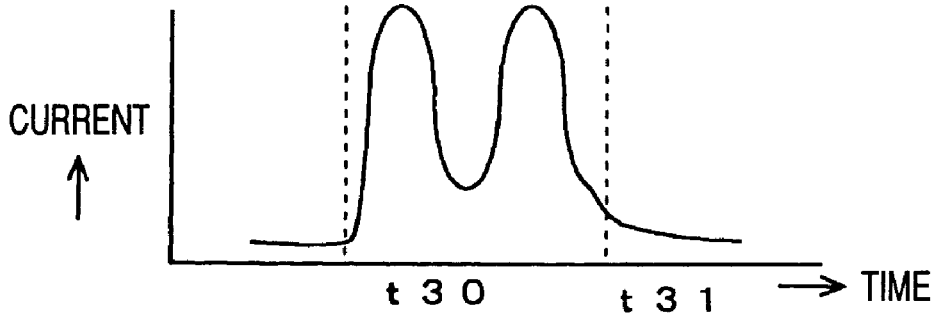
Figure 12C:
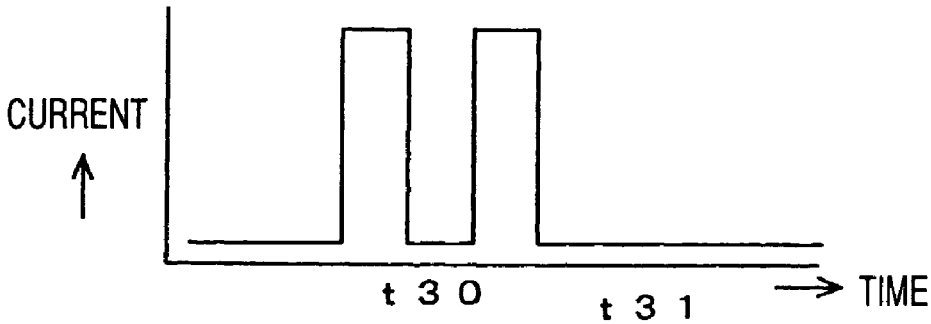

FIG. 12 illustrates examples of an energization pattern, which is accomplished by the current supplying section 92. FIG. 12A illustrates a potential variation at the input signal line 4, wherein it is supposed that a potential exceeds the predetermined potential VX at time t30 and lowers below the predetermined potential VX at time t31. FIG. 12B illustrates an energization pattern in which the current supplying section 92 supplies a pulsating current as the corrosion-prevention current. FIG. 12C illustrates an energization pattern in which the current supplying section 92 supplies the corrosion-prevention current in a burst shape. Since the current supplying section 92 can supply the corrosion-prevention current by changing an energization pattern, it is possible to select an energization pattern depending upon a kind of the contact 3 and to change an energization pattern when the contact 3 cannot be recovered, whereby corrosion of the contact can be reliably prevented. By reliably preventing the corrosion of the contact 3, a frequency of operation for allowing the corrosion-prevention current to flow decreases, whereby it is possible to prevent malfunction when using the opened and closed states of the contact 3.

If the current supplying section 92 supplies the corrosion-prevention current as a pulsating current which varies smoothly, the corrosion prevention operation can have a low noise generation level. Since the corrosion prevention operation has a low noise generation level, it is possible to prevent malfunction when using the opened and closed states of the contact 3. If the current supplying section 92 supplies the corrosion-prevention current in a burst shape, since the contact 3 can be reliably recovered when it is judged that the corrosion of the contact 3 takes place, the frequency of corrosion prevention operation can be decreased. As a result, it is possible to prevent malfunction when using the opened and closed states of the contact 3.

Figure 13:
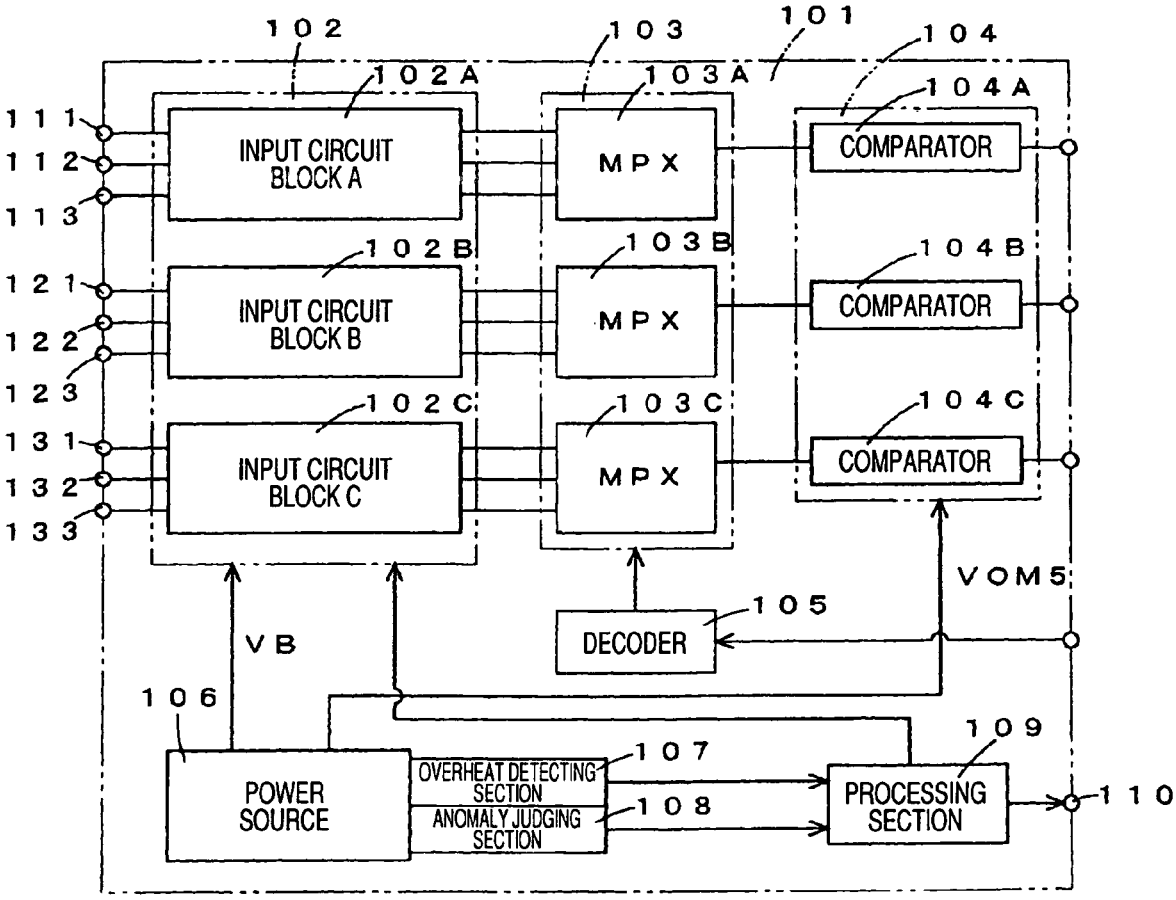
FIG. 13 is a block diagram illustrating a schematic electrical configuration of an apparatus 10 for preventing corrosion of a contact in accordance with an eleventh embodiment of the present invention.

FIG. 13 illustrates a schematic electrical configuration of an apparatus 101 for preventing corrosion of a contact in accordance with an eleventh embodiment of the present invention. The apparatus 101 for preventing corrosion of a contact is formed as an LSI which has a function capable of selecting a plurality of input signals. That is to say, the apparatus 101 has an input circuit block 102 having a plurality of channels. Therefore, in the apparatus 101, the outputs of the plurality of channels from the input circuit block 102 are selected by a multiplexer 103, logical judgment is made by a comparator 104, and judgment result is output. The input circuit block 102 comprises an input circuit block 102A, an input circuit block 102B and an input circuit block 102C which have different circuit configurations. The multiplexer 103 comprises a multiplexer MPX103A for selecting a channel of the input circuit block 102A, a multiplexer MPX103B for selecting a channel of the input circuit block 102B, and a multiplexer MPX103C for selecting a channel of the input circuit block 102C. The inputs respectively selected by the multiplexers MPX103A, MPX103B and MPX103C are judged as logical values by comparators 104A, 104B and 104C which constitute a comparator 104. The selection of channels by the multiplexer 103 is implemented depending upon an output from a decoder 105.

A positive source potential VB from a power source 106 is supplied to the input circuit block 102. A source potential VOM5 of +5V for logical circuits is supplied from the power source 106 to the comparator 104. An overheat detecting section 107 and an anomaly judging section 108 are provided adjacent to the power source 106. The detection result of the Over heat detecting section 107 and the judgment result of the anomaly judging section 108 are applied to processing section 109, and operation including output of an abnormal signal to an external terminal 110 is implemented as protective operation.

A plurality of input channels of the input circuit block 102A are respectively connected to input terminals 111, 112, 113, . . . . A plurality of input channels of the input circuit block 102B are respectively connected to input terminals 121, 122, 123, . . . . A plurality of input channels of the input circuit block 102C are respectively connected to input terminals 131, 132, 133, . . . .

Figure 14:
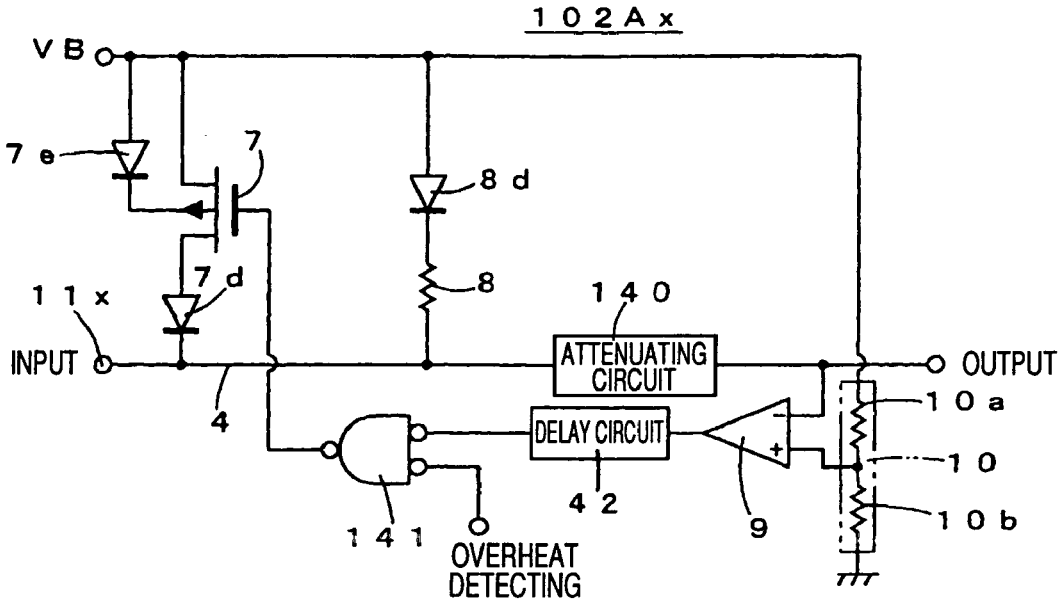
FIG. 14 is a block diagram illustrating a schematic electrical configuration of a corrosion prevention apparatus 102Ax which is included in an input circuit block 102A of FIG. 13.

FIG. 14 illustrates a schematic electrical configuration of a corrosion prevention apparatus 102Ax for one channel of the input circuit block 102A. It is supposed that an input terminal 11*x* to which the input signal line 4 is connected is used in a state in which the input terminal 11*x* is connected to the low side of the power source. The input signal line 4 is finally connected to the comparator 104A, and, by the potential of the input signal line 4, judgment for on and off states of a switch, a connector, etc. is made. An attenuating circuit 140 is inserted into the input signal line 4. A diode 8*d* is connected in series to the resistor 8 being The impedance element, to prevent backward current flow. The output of the comparator 9 serving as a comparator is applied to the switching element 7 through a delay circuit 42 and a gate circuit 141. When the switching element 7 is embodied as a P channel MOS transistor, a diode 7*d* is connected between the drain of the P channel MOS transistor and the input signal line 4, to prevent backward current flow. A diode 7*e* is further connected between the back gate of the P channel MOS transistor and the source potential VB. An overheating detection signal from the processing section 109 of FIG. 13 is applied to one input of the gate circuit 141. The overheating detection signal is of a low level when an overheated state is not detected, and is of a high level when an overheated sate is detected, to be prevented from turning on the switching element 7. The gate circuit 141 is equivalent to an OR circuit.

Figure 15:
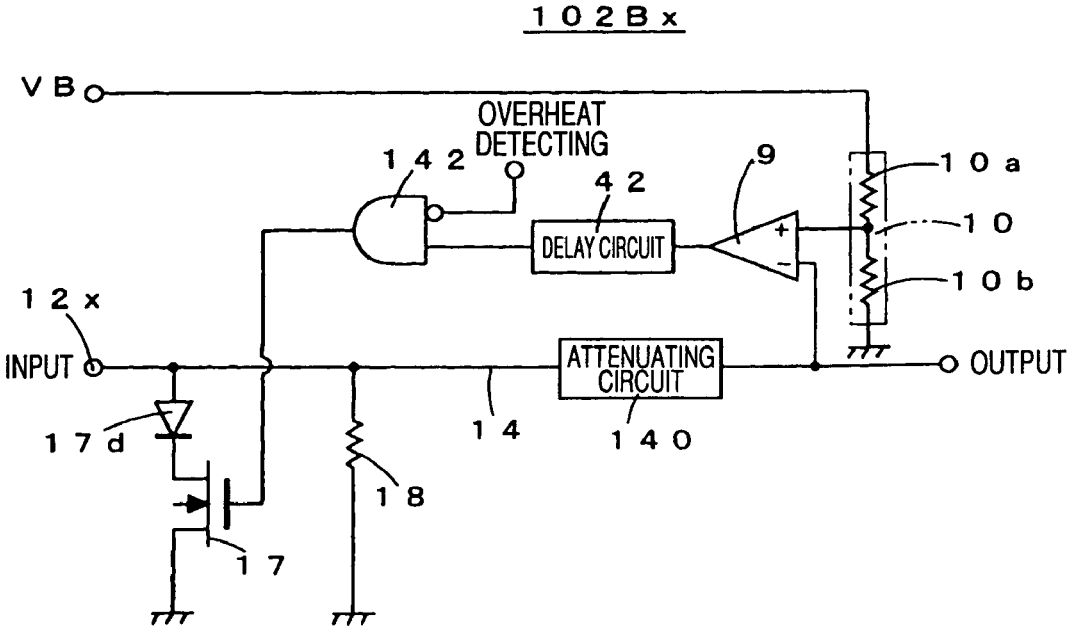
FIG. 15 is a block diagram illustrating a schematic electrical configuration of a corrosion prevention apparatus 102Bx which is included in another input circuit block 102B of FIG. 13.

FIG. 15 illustrates a schematic electrical configuration of a corrosion prevention apparatus 102Bx for one channel of the input circuit block 102B. It is supposed that an input terminal 12*x* to which the input signal line 4 is connected is used in a state in which the input terminal 11*x* is connected to the high side of the power source. The input signal line 14 is finally connected to the comparator 104B, and, by the potential of the input signal line 4, judgment for on and off states of a switch, a connector, etc. is made. The switching element 17 serving as a switch is embodied as an N channel MOS transistor. The switching element 17 is connected between the input signal line 14 and the ground, along with the resistor 18 being The impedance element. A diode 17*d* is connected in series between the drain of the N channel MOS transistor being the switching element 17 and the input signal line 14, to prevent backward current flow. The output of the comparator 9 serving as a comparator is applied to the switching element 17 through a delay circuit 42 and a gate circuit 142. An overheating detection signal from the processing section 109 of FIG. 13 is applied to one input of the gate circuit 142. The overheating detection signal is of a low level when an overheated state is not detected, and is of a high level when an overheated sate is detected, to prevent the switching element 17 from being turned on.

Figure 16:
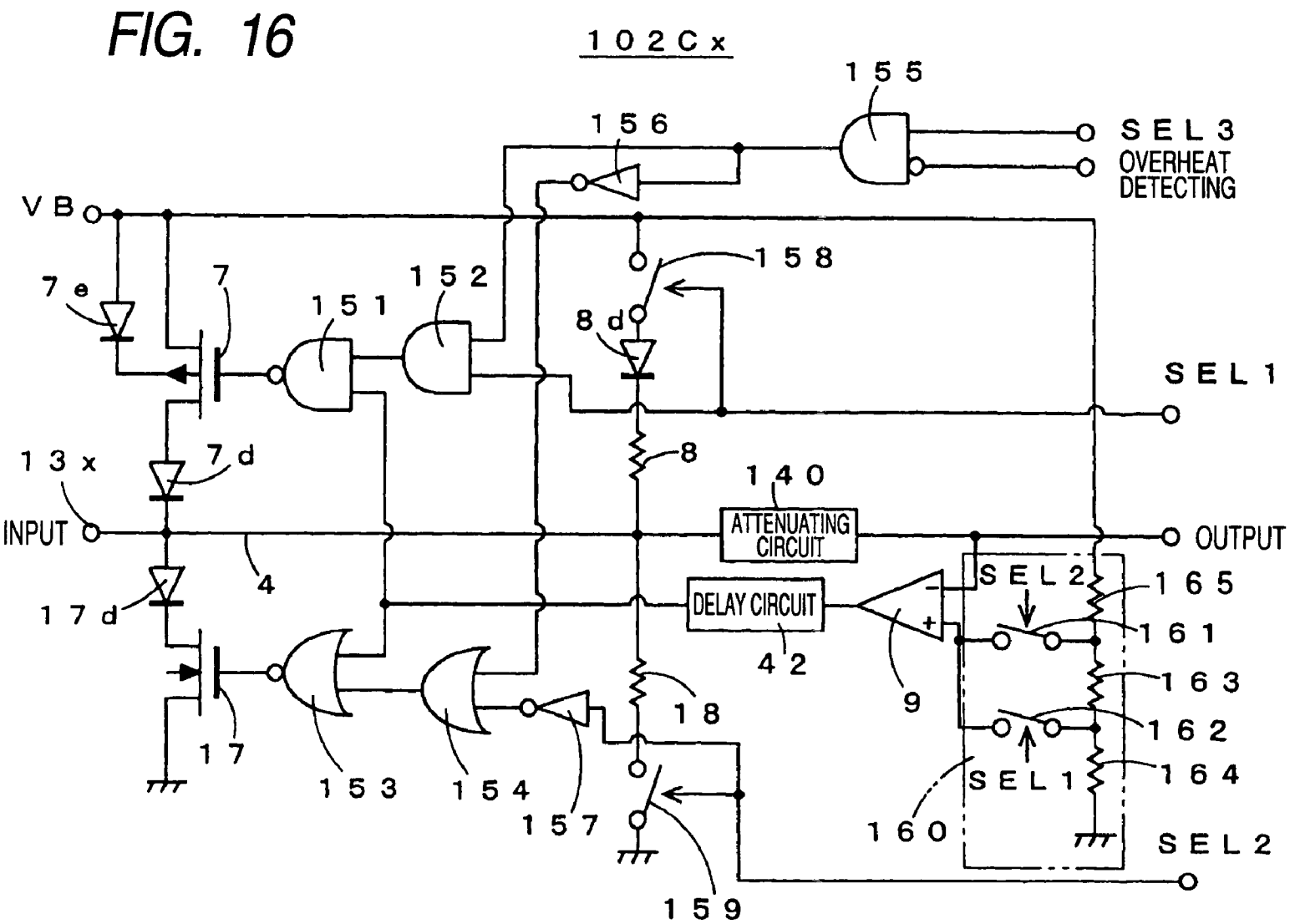
FIG. 16 is a block diagram illustrating a schematic electrical configuration of a corrosion prevention apparatus 102Cx which is included in still another input circuit block 102C of FIG. 13.

FIG. 16 illustrates a schematic electrical configuration of a corrosion prevention apparatus 102Cx for one channel of the input circuit block 102C. It is supposed that an input terminal 13*x* to which the input signal line 4 is connected is used in a state in which the input terminal 13*x* is connected to not only the low side but also the high side of the power source. The input signal line 4 is finally connected to the comparator 104C, and, by the potential of the input signal line 4, judgment for on and off states of a switch, a connector, etc. is made. The logical output of the comparator 9 is applied to the switching element 7 through a NAND circuit 151 to which an output from the delay circuit 42 is applied as one input. An output from an AND circuit 152 is applied to another input of the NAND circuit 151. The logical output of the comparator 9 is applied to the switching element 17 through a NOR circuit 153 to which an output from the delay circuit 42 is applied as one input. An out put from an OR circuit 154 is applied to another input of the NOR circuit 153. An output from a gate circuit 155 and an input of SEL1 are applied to the AND circuit 152. A signal obtained through logic inversion of the output of the gate circuit 155 by an inverter 156 and a signal obtained through logic inversion of the input of SEL2 by an inverter 157 are applied to the OR circuit 154. An input signal of SEL3 and an overheating detection signal are applied to the gate circuit 155.

If the input of the SEL1 becomes a high level, a switch 158 is turned on, and the resistor 8 is connected between the input signal line 4 and the source potential VB as an impedance element. If the input of the SEL2 becomes a high level, a switch 159 is turned on, and the resistor 18 is connected between the input signal line 4 and the ground as an impedance element. If SEL2 and SEL1 become a high level, the switches 161 and 162 of a reference potential source 160 are turned on respectively. By this fact, through conversion of a divider circuit formed by resistors 163, 164 and 165, it is possible to change a predetermined potential of the comparator 9.

FIG. 17 illustrates function selection states in the input circuit block 102C by the three selection signals SEL1, SEL2 and SEL3 of FIG. 16. If SEL1 is a high level, as in the case of the input circuit block 102A, it is possible to connect a switch to the low side. If SEL2 is a high level, as in the case of the input circuit block 102B, it is possible to connect a switch to the high side. If SEL3 is a high level, the function of preventing corrosion of the contact can be rendered.

As described above, in the corrosion preventing apparatus 101, channels to which the input signal lines 4 and 14 are connected are provided to each of the plurality of contacts. The Overheat detecting section 107 detects whether or not a predetermined overheated state is developed while the corrosion-prevention current flows to the input signal line 4 of any one channel. When the corrosion-prevention current does not flow, since no heat is substantially generated, an overheated state is not developed. The processing section 109 serves as an operation inhibiting section. In this regard, when the overheated state is detected as a result of detection by the Overheat detecting section 107, the processing section 109 controls the switching devices 7 and 17 serving as a switch of the channels which allow the corrosion-prevention current to flow, to forbid the operation for allowing the corrosion-prevention current to flow. The processing section 109 has a function of detecting whether or not the corrosion-prevention current flows through the respective channels and a function of maintaining only the channels to which the corrosion-prevention current flows, at a high level. When abnormal operation is implemented as in the case that the corrosion-prevention current continuously flows, protective operation for reducing heat by preventing the corrosion-prevention current from flowing is implemented, whereby it is possible to prevent the corrosion prevention function for the other contacts from being ineffective.

Also, the anomaly judging section 108 monitors the corrosion-prevention current which flows from the power source 106 to the respective input signal lines 4 and 14, and, if at least a portion is overlapped in the plurality of input signal lines 4 and 14 for the time period during which the corrosion-prevention current flows, the abnormality is judged. Also, the anomaly judging section 108 monitors the driving signals of the switching devices 7 and 17, and, if the driving signals for activating the switching devices 7 and 17 are overlapped, abnormality is judged. In general, since a current application frequency of the corrosion-prevention current is low, an happening in which the corrosion-prevention current flows frequently in a overlapped manner at the plurality of contacts does not occur. At the judgment of abnormality of the contacts, the corrosion prevention operation is independently implemented for the respective contacts to be overlapped in the aspect of time. The anomaly judging section monitors the corrosion-prevention current flowing through the respective input signal lines, and, if at a portion of the time period during which the corrosion-prevention current flows or the time period during which the corrosion-prevention current can flow is overlapped, the abnormality is judged, whereby the abnormality judgment can be easily conducted.

Figure 18:
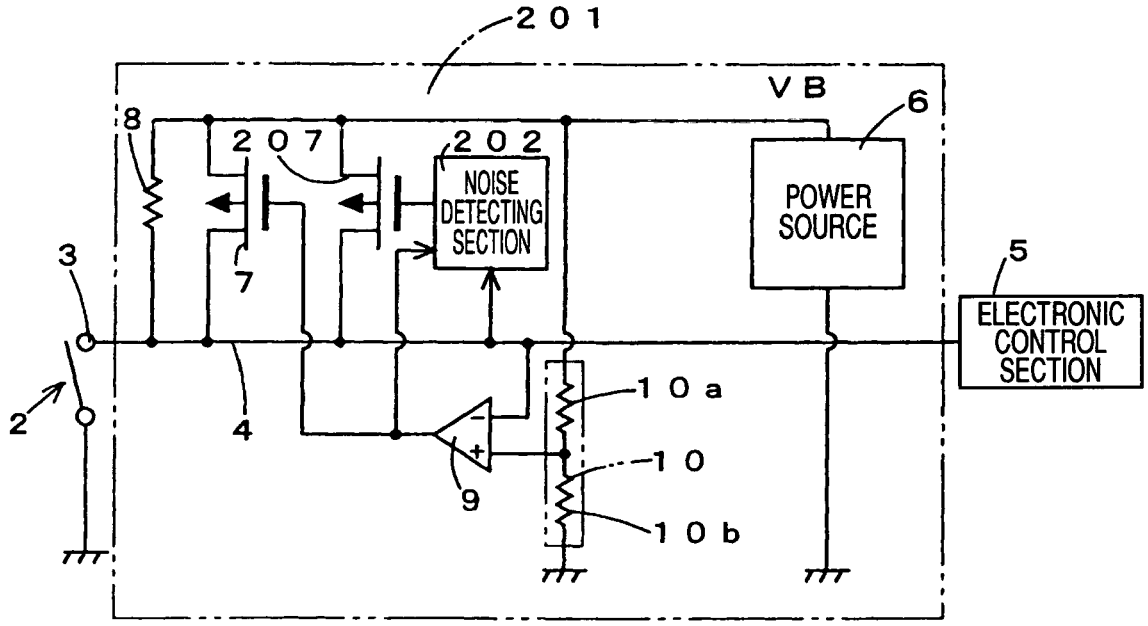
FIG. 18 is a block diagram illustrating a schematic electrical configuration of an apparatus 201 for preventing corrosion of a contact in accordance with a twelfth embodiment of the present invention.

FIG. 18 illustrates a schematic electrical configuration of an apparatus 201 for preventing corrosion of a contact in accordance with a twelfth embodiment of the present invention. The contact corrosion prevention apparatus 201 further includes a noise detecting section 202 and a switching element 207. The noise detecting section 202 detects noise of the input signal line 4. When the noise detecting section 202 detects noise, the switching element 207 serves as an impedance decreasing section, which further decreases the impedance of the input signal line 4, which is controlled by the switching element 7 serving as a switch to have a low impedance. Therefore, when the noise detecting section 202 detects noise, the switching element 207 serving as the impedance decreasing section further decreases the impedance of the input signal line 4. Accordingly, noise-resistant characteristic is improved and a potential variation of the input signal line 4 due to noise is suppressed. As a result, it is possible to prevent malfunction when the opened/closed states of the contact 3 is used. If the noise detecting section 202 does not detect noise, a decrease in the impedance of the input signal line 4 by the switching element 207 does not occur. Therefore, it is possible to prevent impedance from always being lowered. If the impedance is always lowered, the corrosion-prevention current increases. Therefore, there is a fear that reliability in the contact or a rear processing circuit may be deteriorated. Only when the noise is detected and the lowering of the impedance is required, the impedance of the input signal line 4 is decreased to a level, which is lower than that achieved when the switch is turned on.

Figure 19A:
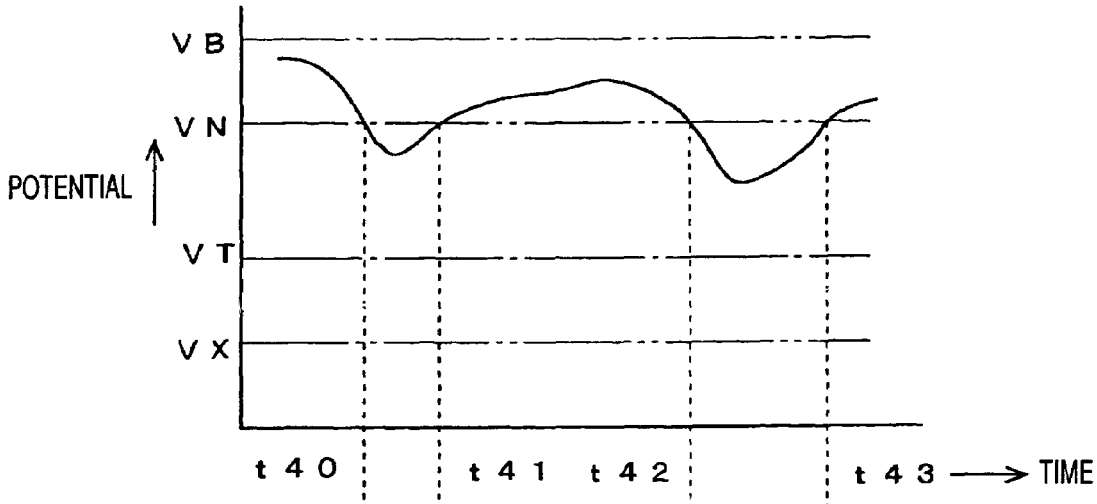
FIG. 19 is timing charts respectively illustrating exemplary potential variation and impedance variation of an input signal line 4 of FIG. 18.
Figure 19B:
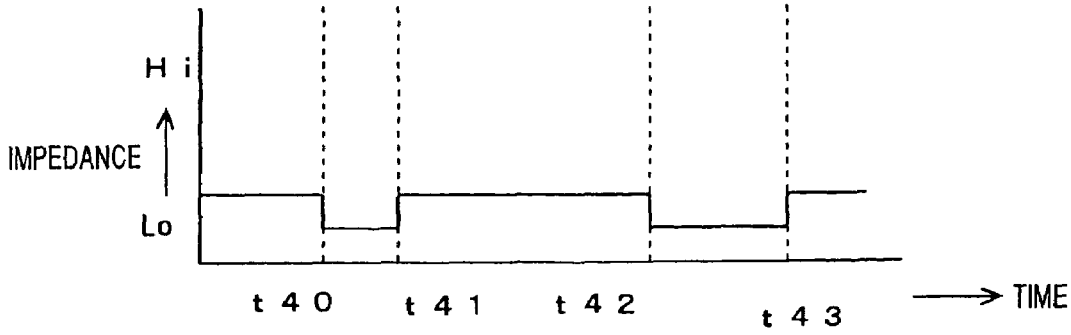

FIG. 19 illustrates examples of the relationship between a potential variation and an impedance variation of the input signal line 4 with the switch 2 turned on. FIG. 19A illustrates a potential variation, and FIG. 19B illustrates an impedance variation. When the switch 2 is in the off state, the switching element 7 is turned on. Therefore, the impedance of the input signal line 4 becomes a low impedance state. Because the contact 3 of the switch 2 is opened, the potential of the input signal line 4 is higher than the threshold level VT and is maintained around the source potential VB. If noise is superposed on the input signal line 4, the potential thereof decreases. If the potential of the input signal line 4 deceases further than the reference level VN of the noise detecting section 202 at time t40, the switching element 207 is turned on. As a result, the impedance of the input signal line 4 is further lowered. That is to say, the impedance of the input signal line 4 decreases during the time period between time t40 and t41 and during the time period between time t42 and t43, during which the potential of the input signal line 4 decreases to be lower than the reference level VN.

Also, as shown in FIG. 19A, the noise detecting section 202 judges whether or not noise is detected, based on the reference level VN, which set to be on the one side with respect to the threshold level VT in the magnitude relation. In other words, the reference level VN is set so that the reference level VN and the predetermined potential VX are located across the threshold level VT. As shown in the drawing, if the contact 3 is associated with the low side switch 2, the predetermined potential VX, which is used to judge whether or not the contact 3 is corroded with the switch 2 being closed, is set toward the ground potential, and the reference level VN based on which a noise level is detected with the switch 2 being opened is set toward the source potential VB. As a result, it is possible to detect that the potential of the input signal line 4 lowers below the reference level VN due to noise decreases.

Figure 20:
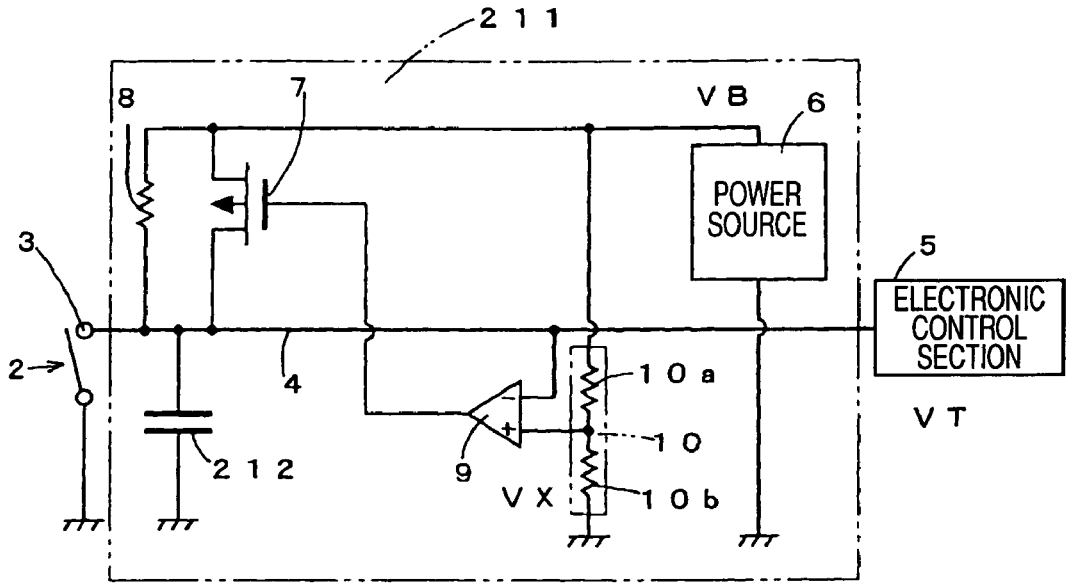
FIG. 20 is a block diagram illustrating a schematic electrical configuration of an apparatus 21 for preventing corrosion of a contact in accordance with a thirteenth embodiment of the present invention.

FIG. 20 illustrates a schematic electrical configuration of an apparatus 211 for preventing corrosion of a contact in accordance with a thirteenth embodiment of the present invention. The apparatus 211 further includes a condenser 212 serving as a high-frequency low-impedance element. The condenser 212 is connected to the input signal line 4. When the signal input to the input signal line 4 is of a high frequency, the condenser 212 can further decrease the impedance of the input signal line 4 to be lower than the impedance obtained by turning on the switching element 7. If the corrosion of the contact 3 proceeds and then the potential of the input signal line 4 exceeds the predetermined potential VX, the comparator 9 serving as a comparator controls the switching element 7 to flow the corrosion-prevention current. Therefore, flowing of the corrosion-prevention current prevents the proceeding of the corrosion of the contact 3 and restores the contact 3 from the corroded state. When the signal input into the input signal line 4 has a high frequency, the condenser 212 serving as a high-frequency low-impedance element can further decrease the impedance of the input signal line 4 to be lower than the impedance obtained by turning on the switching element 7 serving as a switch. Therefore, even when noise of a high frequency is superposed on the input signal line 4, the potential there of does not increase. As a result, the noise-resistant characteristic is improved so as not to be influenced by noise. Also, it is possible to prevent malfunction when using an opened/closed state of the contact 3.

Figure 21:
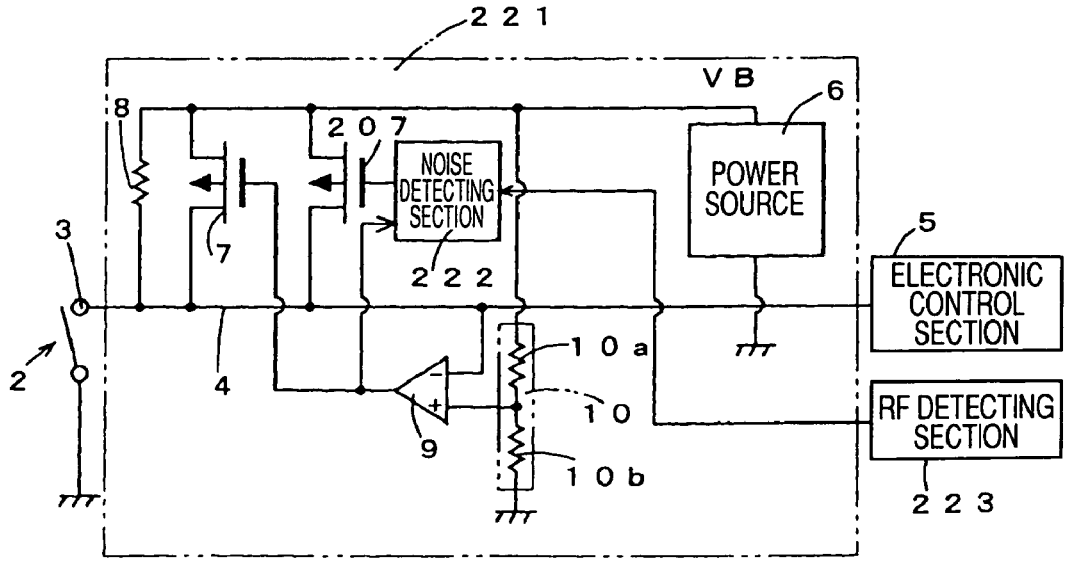
FIG. 21 is a block diagram illustrating a schematic electrical configuration of an apparatus 221 for preventing corrosion of a contact in accordance with a fourteenth embodiment of the present invention.

FIG. 21 illustrates a schematic electrical configuration of an apparatus 221 for preventing corrosion of a contact in accordance with a fourteenth embodiment of the present invention. The apparatus 221 further includes a switching element 207 and a noise detecting section 222. An RF detection signal from an external RF detecting section 223 is input to the noise detecting section 222. The noise detecting section 222 serves as an interference detecting section for detecting radio interference. The switching element 207 serves as an impedance decreasing section for further decreasing the impedance of the input signal line 4, which decreases by turning on the switching element 7 serving as a switch. If the noise detecting section 222 does not detect radio interference, the switching element 207 does not decrease the impedance of the input signal line 4. Therefore, it is possible to prevent the impedance from always being lowered. If the impedance of the input signal line 4 always decreases, the corrosion-prevention current increases. Accordingly, reliability in the contact 3 or a rear processing circuit is deteriorated.

As apparent from the above description, the potential of the input signal line 4, which is connected to the contact 3, is compared with the predetermined potential VX at which the contact 3 maybe corroded. When it is judged that the corrosion takes place, the corrosion-prevention current is applied to the contact 3 by the method for preventing corrosion of a contact, which causes the corrosion-prevention current to flow through the contact 3. Thus, as the impedance of the input signal line 4 decreases with respect to noise, noise-resistant characteristic is improved, and a potential variation of the input signal line 4 by noise is suppressed. As a result, it is possible to prevent malfunction when using an opened or a closed state of the contact 3.

What is claimed is:

1. A method for preventing corrosion of a contact, the method comprising:

comparing a potential of a signal line connected to the contact with a predetermined potential corresponding to the corrosion of the contact, wherein (a) when the potential of the signal line is on one side with respect to the predetermined potential in a magnitude relation, a result of the comparing shows that the contact is corroded; and (b) when the potential of the signal line is on the other side with respect to the predetermined potential in the magnitude relation, the result of the comparing shows that the contact is not corroded;

flowing a corrosion-prevention current into the contact when the result of the comparing shows that the contact is corroded;

inputting into the signal line a signal used for judging a logical value of a connection state of the contact; and in the magnitude relation, setting the predetermined potential on the other side with respect to a threshold level used in the judging of the logical value of the connection state of the contact, wherein, when the result of the comparing shows that the contact is corroded, a logical value of Hi is outputted; and wherein, when the result of the comparing shows that the contact is not corroded, a logical value of Lo is outputted.

2. A method for preventing corrosion of a contact, the method comprising:

comparing a potential of a signal line connected to the contact with a predetermined potential corresponding to the corrosion of the contact;

flowing a corrosion-prevention current into the contact when a result of the comparing shows that the contact is corroded; and reducing frequency of the flowing of the corrosion-prevention current.

3. A method for preventing corrosion of a contact, the method comprising:

comparing a potential of a signal line connected to the contact with a predetermined potential corresponding to the corrosion of the contact;

flowing a corrosion-prevention current into the contact when a result of the comparing shows that the contact is corroded; and reducing an impedance of the signal line with respect to a noise.

4. An apparatus for preventing corrosion of a contact, the apparatus comprising:

a signal line connected to the contact wherein a potential of the signal line is used for judging a connection state of the contact;

a power source;

a switch connected between the signal line and the power source, wherein when the switch is turned on, the switch allows current to flow into the signal line through the switch;

an impedance element connected in parallel to the switch, between the signal line and the power source, an impedance of the impedance element being larger than that of the switch;

a comparator that compares the potential of the signal line with a predetermined potential corresponding to the corrosion of the contact, wherein:

when the potential of the signal line is on one side with respect to the predetermined potential in a magnitude relation, the comparator judges that the contact is corroded and turns on the switch; and when the potential of the signal line is on the other side with respect to the predetermined potential in the magnitude relation, the comparator shows that the contact is not corroded;

a signal, which is used for judging a logical value of a connection state of the contact, is input into the signal line; and the predetermined potential is set on the other side with respect to a threshold level used in the judging of the logical value of the connection state of the contact, in the magnitude relation, wherein, when the result of the comparing shows that the contact is corroded, a logical value of Hi is outputted; and wherein, when the result of the comparing shows that the contact is not corroded, a logical value of Lo is outputted.

5. The apparatus according to claim 4, further comprising:

a electronic device connected to the signal line, the electronic device judging the logical value of the connection state of the contact on a basis of the threshold level.

6. The apparatus according to claim 4, further comprising:

an A/D conversion section that converts the signal input to the signal line into a digital value, wherein:

the comparator uses the digital value provided by the A/D conversion section as the potential of the signal line, and compares the digital value with the threshold level to judge the logical value of the connection state of the contact.

7. The apparatus according to claim 4, further comprising:

a level changing section that changes the predetermined and the threshold level.

8. The apparatus according to claim 4, wherein the comparator has hysteresis characteristic in the predetermined potential.

9. The apparatus according to claim 4, further comprising:

a current holding section that keeps flowing the current into the signal line through the switch and the impedance element for a predetermined time period from a timing at which the comparator turns on the switch to flow the current.

10. The apparatus according to claim 4, further comprising:

a process inhibiting section inserted into the signal line, the process inhibiting section that inhibits a signal processing performed in a subsequent stage thereof when the comparator turns on the switch to flow the current into the signal line through the switch and the impedance element.

11. The apparatus according to claim 10, wherein:

a processing circuit is connected to the signal line in the subsequent stage of the process inhibiting section; and the process inhibiting section fixes an output of the processing circuit during a period in which the current flows through the switch and the impedance element into the signal line.

12. The apparatus according to claim 11, wherein the process inhibiting section fixes the output of the processing circuit for a predetermined time period after the current stops flowing through the switch.

13. The apparatus according to claim 4, wherein:

the impedance element includes a plurality of impedance elements having higher impedances than the switch; and at least one of the plurality of impedance elements is selected.

14. The apparatus according to claim 4, further comprising:

a signal relaxing section, wherein:

when the comparator judges that the contact is corroded, the comparator outputs a driving signal to the switch to turn on the switch; and when the comparator outputs the driving signal, the relaxing section relaxes variation of the driving signal.

15. The apparatus according to claim 4, further comprising:

a delay section, wherein:

when the comparator judges that the contact is corroded, the comparator outputs a driving signal to the delay section; and when the comparator outputs the driving signal, the delay section transmits the driving signal to the switch after the comparator keeps judging that the contact is corroded for a predetermined time period.

16. The apparatus according to claim 4, wherein:

the comparator comprises a counter that counts number of times the potential of the signal line changes from the other side with respect to the predetermined potential to the one side thereof; and when the counted number by the counter reaches predetermined number, the comparator turns on the switch.

17. The apparatus according to claim 16, wherein the comparator counts the number of times per a predetermined time period by using the counter.

18. The apparatus according to claim 4, further comprising:

a current supplying section that supplies pulsating current that changes smoothly as the current flowing through the switch and the impedance element into the signal line.

19. The apparatus according to claim 4, further comprising:

a current supplying section that supplies the current, which flows through the switch and the impedance element into the signal line, in a burst shape.

20. The apparatus according to claim 4, further comprising:

a current supplying section that supplies the current flowing through the switch and the impedance element while changes an energization pattern.

21. The apparatus according to claim 4, further comprising:

a noise detecting section that detects noise of the signal line; and an impedance decreasing section that decreases an impedance of the signal line when the noise detecting section detects the noise.

22. The apparatus according to claim 21, wherein the noise detecting section detects whether or not the noise is present, on a basis of a reference level set on the one side with respect to the predetermined potential in the magnitude relation.

23. The apparatus according to claim 4, further comprising:

a high-frequency low-impedance element, which is connected to the signal line, wherein:

when the signal input into the signal line is of high frequency, the high-frequency low-impedance element decreases an impedance of the signal line.

24. The apparatus according to claim 4, further comprising:

an interference detecting section that detects radio interference; and an impedance decreasing section that decreases an impedance of the signal line when the interference detecting section detects the radio interference.

* * * * *